US011853016B2

(12) United States Patent
Ruaro et al.

(10) Patent No.: US 11,853,016 B2
(45) Date of Patent: Dec. 26, 2023

(54) ELECTRONIC DEVICE WIDE BAND ANTENNAS

(71) Applicant: Apple Inc., Cupertino, CA (US)

(72) Inventors: Andrea Ruaro, Campbell, CA (US); Eduardo Jorge Da Costa Bras Lima, Sunnyvale, CA (US); Mario Martinis, Cupertino, CA (US); Dimitrios Papantonis, Cupertino, CA (US); Jayesh Nath, Milpitas, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 898 days.

(21) Appl. No.: 16/584,472

(22) Filed: Sep. 26, 2019

(65) Prior Publication Data

US 2021/0096515 A1 Apr. 1, 2021

(51) Int. Cl.

| | |
|---|---|
| ***H01Q 1/22*** | (2006.01) |
| ***H01Q 1/27*** | (2006.01) |
| ***H01Q 1/38*** | (2006.01) |
| ***H01Q 3/10*** | (2006.01) |
| ***H01Q 5/25*** | (2015.01) |

(Continued)

(52) U.S. Cl.

CPC ..... *G04R 60/10* (2013.01); *G04G 17/08* (2013.01); *H01Q 1/2291* (2013.01); *H01Q 1/273* (2013.01); *H01Q 1/38* (2013.01); *H01Q 5/25* (2015.01); *H01Q 5/307* (2015.01); *H01Q 13/10* (2013.01)

(58) Field of Classification Search

CPC ..... G04R 60/10; G04R 60/12; G04G 17/08; G04G 21/04; H01Q 1/2291; H01Q 1/273; H01Q 1/38; H01Q 5/25; H01Q 5/307; H01Q 13/10; H01Q 5/40; H01Q 9/42; H01Q 21/28

See application file for complete search history.

(56) References Cited

U.S. PATENT DOCUMENTS

| | | | |
|---|---|---|---|
| 6,825,810 | B2 | 11/2004 | Ragner et al. |
| 8,686,902 | B2 | 4/2014 | Lopez et al. |

(Continued)

FOREIGN PATENT DOCUMENTS

| | | |
|---|---|---|
| EP | 3190713 | 8/2019 |

*Primary Examiner* — Hai V Tran
*Assistant Examiner* — Michael M Bouizza
(74) *Attorney, Agent, or Firm* — Treyz Law Group, P.C.; Tianyi He

(57) ABSTRACT

An electronic device such as a wristwatch device may have a housing with metal sidewalls and a display module having conductive display structures. The conductive display structures may be separated from the sidewalls by a slot element for a first antenna that runs around the display module. A feed element for the first antenna may be coupled between the display structures and the sidewalls. An antenna resonating element for a second antenna may be disposed within the slot element. A printed circuit may include additional antenna elements for the second antenna. The antenna resonating element may extend away from the feed element for the first antenna to provide improved isolation between the two antennas. The first antenna may be operable to provide coverage for frequencies that are lower than frequencies for which the second antenna may be operable to provide coverage.

20 Claims, 11 Drawing Sheets

(51) Int. Cl.

| | |
|---|---|
| ***H01Q 5/307*** | (2015.01) |
| ***G04R 60/10*** | (2013.01) |
| ***H01Q 13/10*** | (2006.01) |
| ***G04G 17/08*** | (2006.01) |

(56) References Cited

U.S. PATENT DOCUMENTS

| | | | | |
|---|---|---|---|---|
| 8,860,619 | B2 | 10/2014 | Nysen | |
| 8,964,298 | B2 | 2/2015 | Haddick et al. | |
| 9,024,826 | B2 | 5/2015 | Tolbert et al. | |
| 9,703,272 | B2 | 7/2017 | Fraser et al. | |
| 10,128,890 | B2 | 11/2018 | Thomas et al. | |
| 10,164,323 | B2 | 12/2018 | Kwon et al. | |
| 10,396,431 | B2 | 8/2019 | Ramasamy et al. | |
| 10,658,749 | B2 * | 5/2020 | Ruaro | H01Q 1/52 |
| 2016/0261023 | A1 * | 9/2016 | Di Nallo | H01Q 5/321 |
| 2018/0294576 | A1 | 10/2018 | Niakan et al. | |
| 2019/0074586 | A1 * | 3/2019 | Ruaro | H01Q 13/16 |
| 2019/0214707 | A1 * | 7/2019 | Kim | H01Q 1/243 |

* cited by examiner

ELECTRONIC DEVICE WIDE BAND ANTENNAS

BACKGROUND

This relates to electronic devices and, more particularly, to electronic devices with wireless circuitry.

Electronic devices are often provided with wireless communications capabilities. To satisfy consumer demand for small form factor electronic devices, manufacturers are continually striving to implement wireless circuitry such as antenna components using compact structures.

At the same time, larger antenna volumes generally allow antennas to exhibit greater efficiency bandwidth. In addition, because antennas have the potential to interfere with each other and with other components in a wireless device, care must be taken when incorporating antennas into an electronic device to ensure that the antennas and wireless circuitry are able to exhibit satisfactory performance over a wide range of operating frequencies.

It would therefore be desirable to be able to provide improved wireless circuitry for electronic devices.

SUMMARY

An electronic device such as a wristwatch may have a housing that includes conductive sidewalls. A display cover layer for a display may be mounted to the housing. The display may include conductive display structures that overlap the display cover layer. A slot antenna resonating element for a slot antenna may be formed from a slot element defined by the conductive sidewalls and the conductive display structures. An additional antenna resonating element for a second antenna (e.g., an inverted-F antenna, a monopole antenna, or a dipole antenna) may be interposed between the conductive sidewalls and the conductive display structures, disposed in the slot element, and aligned with the slot.

The additional antenna resonating element for the second antenna may be formed on a dielectric support structure within the slot element. The conductive sidewalls may include a first ledge on which the dielectric support structure is mounted and a second ledge to which the display cover layer is coupled using an attachment structure (e.g., mechanical attachment structure, sensor components, etc.).

A printed circuit may be formed on the first ledge, aligned with the slot, and coupled to the additional antenna resonating element. The printed circuit may also include conductive traces that form an antenna ground for the second antenna. The antenna ground for the second antenna may also be formed from the conductive sidewalls. The second antenna may include a return path coupling the additional antenna resonating element to the conductive housing wall using the conductive traces of the printed circuit. The second antenna may include a feed leg coupled to the additional antenna resonating element and may include an antenna feed coupled across the feed leg and the antenna ground for the second antenna. An additional printed circuit having transmission line structure for providing antenna signals to the antenna feed of the second antenna may also be formed on the first ledge, aligned with the slot, and coupled to the printed circuit.

The slot antenna resonating element may be configured to radiate in a first (relatively low) frequency band (e.g., a 2.4 GHz wireless local area network (WLAN) frequency band and a cellular telephone frequency band), and the additional antenna resonating element is configured to radiate in a second (relatively high) frequency band (an ultra-wide band (UWB) frequency band from 5 GHz to 8.5 GHz and a 5 GHz WLAN frequency band). The electronic device may include first high frequency radio-frequency transceiver circuitry configured to convey the radio frequency signals in the UWB frequency band and the 5 GHz WLAN frequency band using the additional antenna resonating element. The electronic device may include second radio-frequency transceiver circuitry configured to convey radio-frequency signals in the 2.4 GHz WLAN frequency band and the cellular telephone frequency band using the slot antenna resonating element.

DETAILED DESCRIPTION

Figure 1:
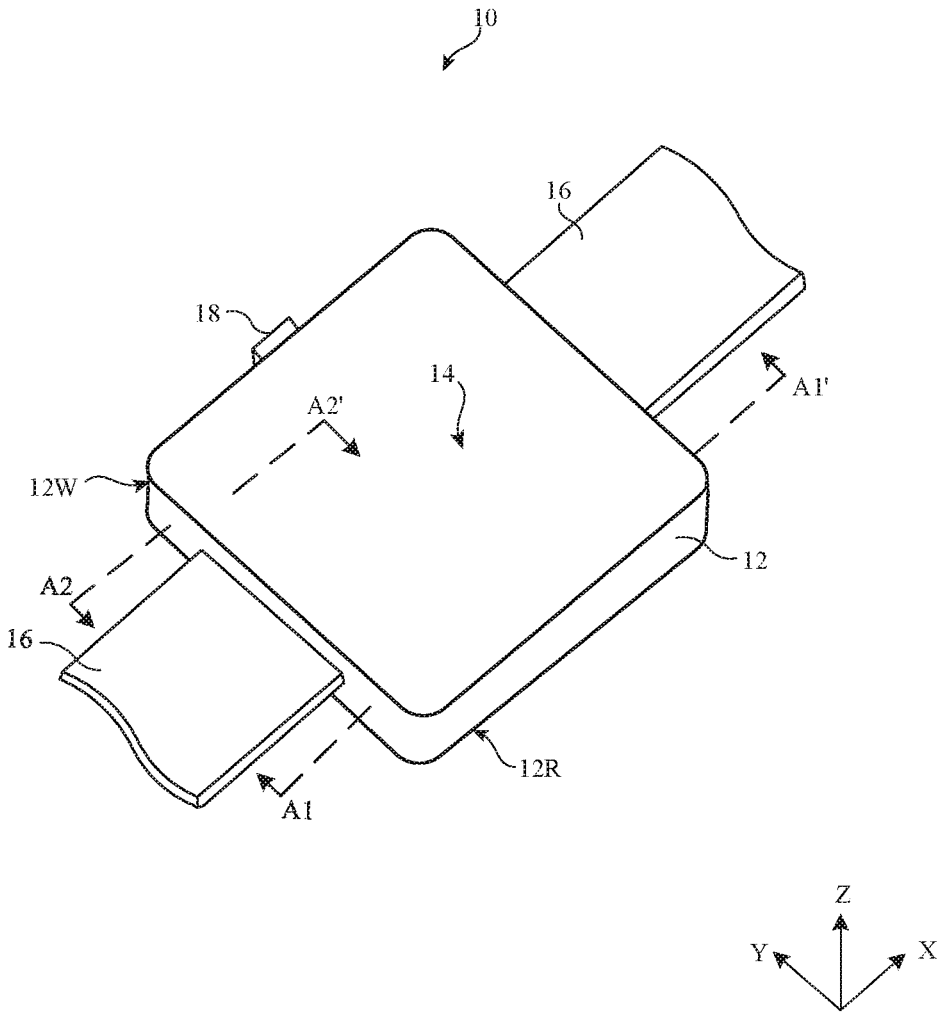
FIG. 1 is a perspective view of an illustrative electronic device with wireless circuitry in accordance with some embodiments.

Electronic devices such as electronic device 10 of FIG. 1 may be provided with wireless circuitry (sometimes referred to herein as wireless communications circuitry). The wireless circuitry may be used to support wireless communications in multiple wireless communications bands. Communications bands (sometimes referred to herein as frequency bands) handled by the wireless circuitry can include satellite navigation system communications bands, cellular telephone communications bands, wireless local area network communications bands, wireless personal area network communications bands, near-field communications bands, ultra-wideband communications bands, or other wireless communications bands.

The wireless circuitry may include one or more antennas. The antennas of the wireless circuitry can include loop antennas, inverted-F antennas, strip antennas, planar inverted-F antennas, patch antennas, slot antennas, hybrid antennas that include antenna structures of more than one type, or other suitable antennas.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a wristwatch (e.g., a smart watch). Other configurations may be used for device 10 if desired. The example of FIG. 1 is merely illustrative.

In the example of FIG. 1, device 10 includes a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Housing 12 may have metal sidewalls such as sidewalls 12W or sidewalls formed from other materials. Examples of metal materials that may be used for forming sidewalls 12W include stainless steel, aluminum, silver, gold, metal alloys, or any other desired conductive material. Sidewalls 12W may sometimes be referred to herein as housing sidewalls 12W or conductive housing sidewalls 12W.

Display 14 may be formed at (e.g., mounted on) the front side (face) of device 10. Housing 12 may have a rear housing wall on the rear side (face) of device 10 such as rear housing wall 12R that opposes the front face of device 10. Conductive housing sidewalls 12W may surround the periphery of device 10 (e.g., conductive housing sidewalls 12W may extend around peripheral edges of device 10). Rear housing wall 12R may be formed from conductive materials and/or dielectric materials. Examples of dielectric materials that may be used for forming rear housing wall 12R include plastic, glass, sapphire, ceramic, wood, polymer, combinations of these materials, or any other desired dielectrics.

Rear housing wall 12R and/or display 14 may extend across some or all of the length (e.g., parallel to the X-axis) and width (e.g., parallel to the Y-axis) of device 10. Conductive housing sidewalls 12W may extend across some or all of the height of device 10 (e.g., parallel to Z-axis). Conductive housing sidewalls 12W and/or rear housing wall 12R may form one or more exterior surfaces of device 10 (e.g., surfaces that are visible to a user of device 10) and/or may be implemented using internal structures that do not form exterior surfaces of device 10 (e.g., conductive or dielectric housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide housing walls 12R and/or 12W from view of the user).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures. Display 14 may also be force-sensitive and may gather force input data associated with how strongly a user or object is pressing against display 14.

Display 14 may include an array of display pixels formed from liquid crystal display (LCD) components, an array of electrophoretic display pixels, an array of plasma display pixels, an array of organic light-emitting diode (OLED) display pixels, an array of electrowetting display pixels, or display pixels based on other display technologies. Display 14 may be protected using a display cover layer. The display cover layer may be formed from a transparent material such as glass, plastic, sapphire or other crystalline dielectric materials, ceramic, or other clear materials. The display cover layer may extend across substantially all of the length and width of device 10, for example.

Device 10 may include buttons such as button 18. There may be any suitable number of buttons in device 10 (e.g., a single button, more than one button, two or more buttons, five or more buttons, etc.). Buttons may be located in openings in housing 12 (e.g., openings in conductive housing sidewall 12W or rear housing wall 12R) or in an opening in display 14 (as examples). Buttons may be rotary buttons, sliding buttons, buttons that are actuated by pressing on a movable button member, etc. Button members for buttons such as button 18 may be formed from metal, glass, plastic, or other materials. Button 18 may sometimes be referred to as a crown in scenarios where device 10 is a wristwatch device.

Device 10 may, if desired, be coupled to a strap such as strap 16. Strap 16 may be used to hold device 10 against a user's wrist (as an example). Strap 16 may sometimes be referred to herein as wrist strap 16. In the example of FIG. 1, wrist strap 16 is connected to opposing sides of device 10. Conductive housing sidewalls 12W may include attachment structures for securing wrist strap 16 to housing 12 (e.g., lugs or other attachment mechanisms that configure housing 12 to receive wrist strap 16). Configurations that do not include straps may also be used for device 10.

Figure 2:
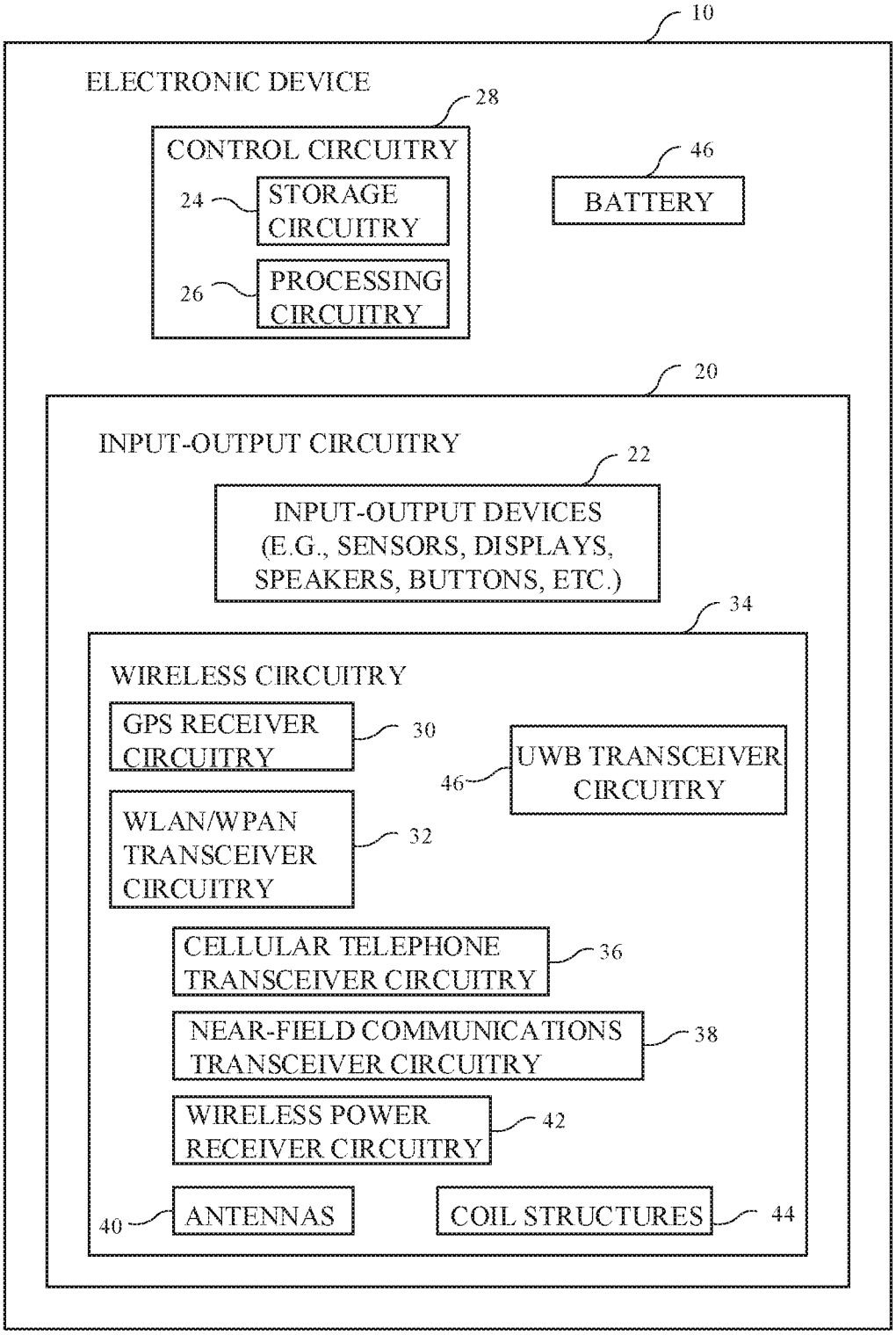
FIG. 2 is a schematic diagram of an illustrative electronic device with wireless circuitry in accordance with some embodiments.

A schematic diagram showing illustrative components that may be used in device 10 is shown in FIG. 2. As shown in FIG. 2, device 10 may include control circuitry 28. Control circuitry 28 may include storage such as storage circuitry 24. Storage circuitry 24 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 26. Processing circuitry 26 may be used to control the operation of device 10. Processing circuitry 26 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 24 (e.g., storage circuitry 24 may include non-transitory (tangible) computer readable storage media that stores the software code). The software code may sometimes be referred to as program instructions, software, data, instructions, or code. Software code stored on storage circuitry 24 may be executed by processing circuitry 26.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other wireless personal area network (WPAN) protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may include input-output circuitry 20. Input-output circuitry 20 may include input-output devices 22. Input-output devices 22 may be used to allow data to be supplied to device 10 and to allow data to be provided from device 10 to external devices. Input-output devices 22 may include user interface devices, data port devices, and other input-output components. For example, input-output devices 22 may include touch screens, displays without touch sensor capabilities, buttons, scrolling wheels, touch pads, key pads, keyboards, microphones, cameras, buttons, speakers, status indicators, light sources, audio jacks and other audio port components, vibrators or other haptic feedback engines, digital data port devices, light sensors (e.g., infrared light sensors, visible light sensors, etc.), light-emitting diodes, motion sensors (accelerometers), capacitance sensors, proximity sensors, magnetic sensors, force sensors (e.g., force sensors coupled to a display to detect pressure applied to the display), etc.

Input-output circuitry 22 may include wireless circuitry 34. Wireless circuitry 34 may include wireless power receiving coil structures such as coil structures 44 and wireless power receiver circuitry such as wireless power receiver circuitry 42. Device 10 may use wireless power receiver circuitry 42 and coil structures 44 to receive wirelessly transmitted power (e.g., wireless charging signals) from a wireless power adapter (e.g., a wireless power transmitting device such as a wireless charging mat or other device).

Wireless power receiver circuitry 42 may include converter circuitry such as rectifier circuitry. Coil structures 44 may include one or more inductive coils that use resonant inductive coupling (near field electromagnetic coupling) with a wireless power transmitting coil on the wireless power adapter. The rectifier circuitry may convert currents from coil structures 44 into a DC voltage for powering device 10. The DC voltage produced by the rectifier circuitry in wireless power receiver circuitry 42 can be used in powering (charging) an energy storage device such as battery 46 and can be used in powering other components in device 10. An illustrative frequency for the wireless charging signals is 200 kHz. Other frequencies may be used, if desired (e.g., frequencies in the kHz range, the MHz range, or in the GHz range, frequencies of 1 kHz to 1 MHz, frequencies of 1 kHz to 100 MHz, frequencies less than 100 MHz, frequencies less than 1 MHz, etc.).

To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

Wireless circuitry 34 may include radio-frequency transceiver circuitry for handling various radio-frequency communications bands. For example, wireless circuitry 34 may include wireless local area network (WLAN) and wireless personal area network (WPAN) transceiver circuitry 32. Transceiver circuitry 32 may handle 2.4 GHz and 5 GHz bands for WiFi® (IEEE 802.11) communications or other WLAN bands and may handle the 2.4 GHz Bluetooth® communications band or other WPAN bands. Transceiver circuitry 32 may sometimes be referred to herein as WLAN/WPAN transceiver circuitry 32.

Wireless circuitry 34 may use cellular telephone transceiver circuitry 36 for handling wireless communications in frequency ranges (communications bands) such as a cellular low band (LB) from 600 to 960 MHz, a cellular low-midband (LMB) from 1410 to 1510 MHz, a cellular mid-band (MB) from 1710 to 2170 MHz, a cellular high band (HB) from 2300 to 2700 MHz, a cellular ultra-high band (UHB) from 3300 to 5000 MHz, or other communications bands between 600 MHz and 5000 MHz or other suitable frequencies (as examples). Cellular telephone transceiver circuitry 36 may handle voice data and non-voice data.

Wireless circuitry 34 may include satellite navigation system circuitry such as Global Positioning System (GPS) receiver circuitry 30 for receiving GPS signals at 1575 MHz or for handling other satellite positioning data (e.g., GLONASS signals at 1609 MHz). Satellite navigation system signals for receiver circuitry 30 are received from a constellation of satellites orbiting the earth. Wireless circuitry 34 can include circuitry for other short-range and long-range wireless links if desired. For example, wireless circuitry 34 may include circuitry for receiving television and radio signals, paging system transceivers, near field communications (NFC) transceiver circuitry 38 (e.g., an NFC transceiver operating at 13.56 MHz or another suitable frequency), etc.

In NFC links, wireless signals are typically conveyed over a few inches at most. In satellite navigation system links, cellular telephone links, and other long-range links, wireless signals are typically used to convey data over thousands of feet or miles. In WLAN and WPAN links at 2.4 and 5 GHz and other short-range wireless links, wireless signals are typically used to convey data over tens or hundreds of feet. Antenna diversity schemes may be used if desired to ensure that the antennas that have become blocked or that are otherwise degraded due to the operating environment of device 10 can be switched out of use and higher-performing antennas used in their place.

Wireless circuitry 34 may include ultra-wideband (UWB) transceiver circuitry 46 that supports communications using the IEEE 802.15.4 protocol and/or other wireless communications protocols (e.g., ultra-wideband communications protocols). Ultra-wideband wireless signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Transceiver circuitry 54 may operate (i.e., convey radio-frequency signals) in frequency bands such as an ultra-wideband frequency band between about 5 GHz and about 8.5 GHz (e.g., a 6.5 GHz frequency band, an 8 GHz frequency band, and/or at other suitable frequencies).

Wireless circuitry 34 may include antennas 40. Antennas 40 may be formed using any suitable antenna types. For example, antennas 40 may include antennas with resonating elements that are formed from slot antenna structures, loop antenna structures, patch antenna structures, stacked patch antenna structures, antenna structures having parasitic elements, inverted-F antenna structures, planar inverted-F antenna structures, helical antenna structures, monopole antennas, dipole antenna structures, Yagi (Yagi-Uda) antenna structures, surface integrated waveguide structures, hybrids of these designs, etc. If desired, one or more of antennas 40 may be cavity-backed antennas.

Different types of antennas may be used for different bands and combinations of bands. For example, one type of antenna may be used in forming a local wireless link antenna whereas another type of antenna is used in forming a remote wireless link antenna. If desired, space may be conserved within device 10 by using a single antenna to handle two or more different communications bands. For example, a single antenna 40 in device 10 may be used to handle communications in a WiFi® or Bluetooth® communication band at 2.4 GHz, a GPS communications band at 1575 MHz, a WiFi® or Bluetooth® communications band at 5.0 GHz, and one or more cellular telephone communications bands such as a cellular low band between about 600 MHz and 960 MHz and/or a cellular midband between about 1700 MHz and 2200 MHz. If desired, a combination of antennas for covering multiple frequency bands and dedicated antennas for covering a single frequency band may be used.

It may be desirable to implement at least some of the antennas in device 10 using portions of electrical components that would otherwise not be used as antennas and that support additional device functions. As an example, it may be desirable to induce antenna currents in components such as display 14 (FIG. 1), so that display 14 and/or other electrical components (e.g., a touch sensor, near-field communications loop antenna, conductive display assembly or housing, conductive shielding structures, etc.) can serve as part of an antenna for Wi-Fi, Bluetooth, GPS, cellular frequencies, and/or other frequencies without the need to incorporate separate bulky antenna structures in device 10. Conductive portions of housing 12 (FIG. 1) may be used to form part of an antenna ground for one or more antennas 40.

Figure 3:
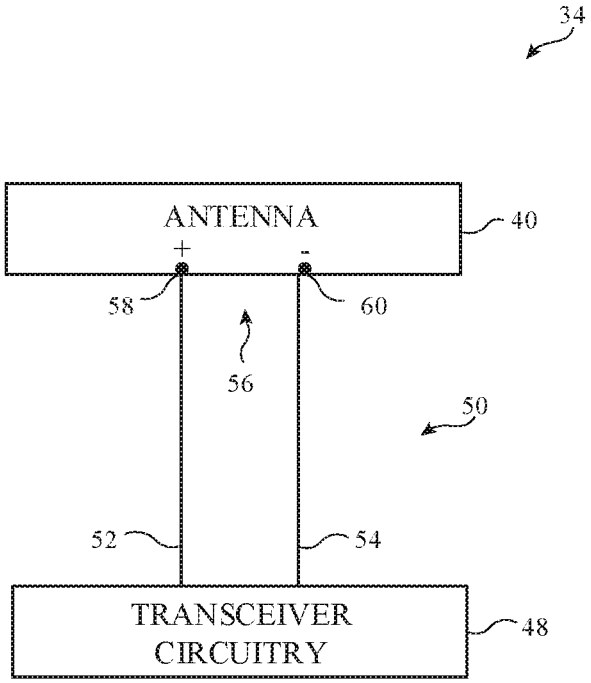
FIG. 3 is a diagram of illustrative wireless circuitry in an electronic device in accordance with some embodiments.

A schematic diagram of wireless circuitry 34 is shown in FIG. 3. As shown in FIG. 3, wireless circuitry 34 may include transceiver circuitry 48 (e.g., cellular telephone transceiver circuitry 36 of FIG. 2, WLAN/WPAN transceiver circuitry 32, UWB transceiver circuitry 46, etc.) that is coupled to a given antenna 40 using a radio-frequency transmission line path such as radio-frequency transmission line path 50.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc.

Radio-frequency transmission line path 50 may include one or more radio-frequency transmission lines (sometimes referred to herein simply as transmission lines). Radio-frequency transmission line path 50 (e.g., the transmission lines in radio-frequency transmission line path 50) may include a positive signal conductor such as signal conductor 52 and a ground signal conductor such as ground conductor 54.

The transmission lines in radio-frequency transmission line path 50 may, for example, include coaxial cable transmission lines (e.g., ground conductor 54 may be implemented as a grounded conductive braid surrounding signal conductor 52 along its length), stripline transmission lines (e.g., where ground conductor 54 extends along two sides of signal conductor 52), a microstrip transmission line (e.g., where ground conductor 54 extends along one side of signal conductor 52), coaxial probes realized by a metalized via, edge-coupled microstrip transmission lines, edge-coupled stripline transmission lines, waveguide structures (e.g., coplanar waveguides or grounded coplanar waveguides), combinations of these types of transmission lines and/or other transmission line structures, etc.

Transmission lines in radio-frequency transmission line path 50 may be integrated into rigid and/or flexible printed circuit boards. In one suitable arrangement, radio-frequency transmission line path 50 may include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of radio-frequency transmission line path 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Radio-frequency transmission line path 50 may be coupled to antenna feed structures associated with antenna 40. As an example, antenna 40 may form an inverted-F antenna, a planar inverted-F antenna, a patch antenna, a loop antenna, or other antenna having an antenna feed 56 with a positive antenna feed terminal such as terminal 58 and a ground antenna feed terminal such as terminal 60. Positive antenna feed terminal 58 may be coupled to an antenna resonating (radiating) element within antenna 40. Ground antenna feed terminal 60 may be coupled to an antenna ground in antenna 40. Signal conductor 52 may be coupled to positive antenna feed terminal 58 and ground conductor 54 may be coupled to ground antenna feed terminal 60.

Other types of antenna feed arrangements may be used if desired. For example, antenna 40 may be fed using multiple feeds each coupled to a respective port of transceiver circuitry 48 over a corresponding transmission line. If desired, signal conductor 52 may be coupled to multiple locations on antenna 40 (e.g., antenna 40 may include multiple positive antenna feed terminals coupled to signal conductor 52 of the same radio-frequency transmission line path 50). Switches may be interposed on the signal conductor between transceiver circuitry 48 and the positive antenna feed terminals if desired (e.g., to selectively activate one or more positive antenna feed terminals at any given time). The illustrative feeding configuration of FIG. 3 is merely illustrative.

Device 10 may include multiple antennas that convey radio-frequency signals through different sides of device 10. For example, device 10 may include at least first antenna that conveys radio-frequency signals through the front face of device 10 (e.g., display 14 of FIG. 1) and a second antenna that conveys radio-frequency signals through the rear face of device 10 (e.g., rear housing wall 12R of FIG. 1). If desired, multiple antennas may convey radio-frequencies through the same face of device 10.

Figure 4:
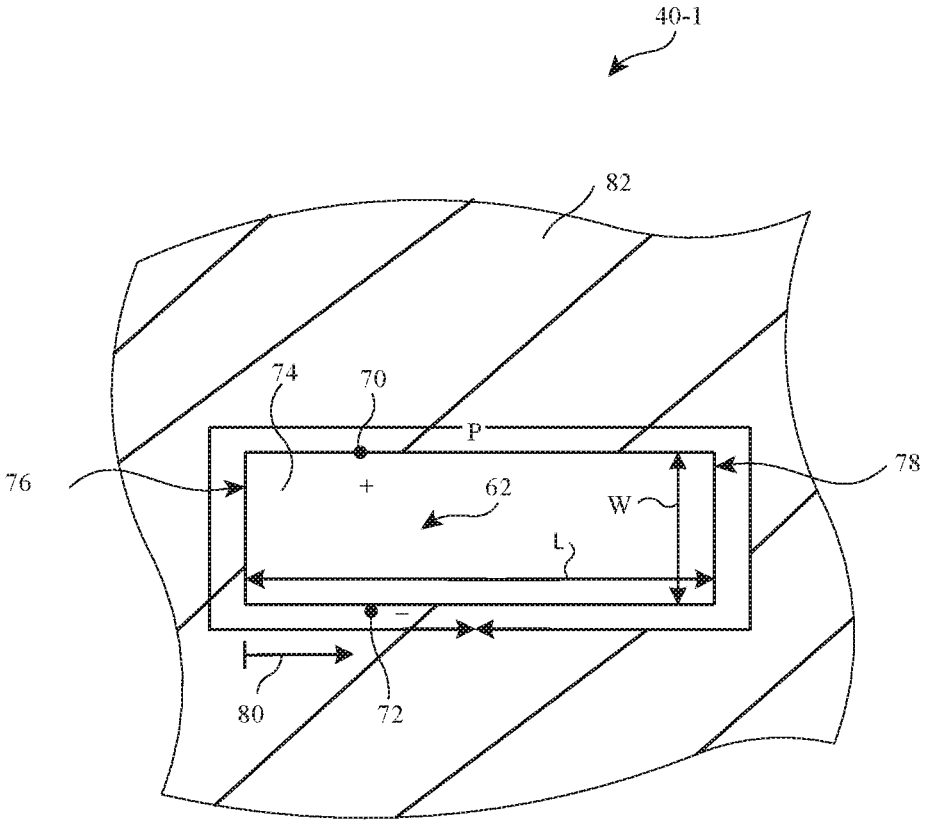
FIG. 4 is a schematic diagram of an illustrative slot antenna in accordance with some embodiments.

Antennas 40 may be formed using any desired antenna structures. In one suitable arrangement, a given antenna 40 such as first antenna 40-1 may be formed using a slot antenna structure. An illustrative slot antenna structure that may be used for forming antenna 40-1 is shown in FIG. 4. As shown in FIG. 4, antenna 40-1 may include a conductive structure such as conductor 82 that has been provided with a dielectric opening such as dielectric opening 74. Opening 74 may sometimes be referred to herein as slot 74, slot antenna resonating element 74, slot element 74, or slot radiating element 74. In the configuration of FIG. 4, slot element 74 is a closed slot, because portions of conductor 82 completely surround and enclose slot element 74. Open slot antennas may also be formed in conductive materials such as conductor 82 (e.g., by forming an opening in the right-hand or left-hand end of conductor 82 so that slot element 74 protrudes through conductor 82).

Antenna feed 62 for antenna 40-1 may be formed using positive antenna feed terminal 70 and ground antenna feed terminal 72. In general, the frequency response of an antenna is related to the size and shapes of the conductive structures in the antenna. Slot antennas of the type shown in FIG. 4 tend to exhibit response peaks when slot perimeter P is equal to the effective wavelength of operation of antenna 40-1 (e.g. where perimeter P is equal to two times length L plus two times width W). The effective wavelength of operation may be equal to a freespace wavelength multiplied by a constant value that is determined by the dielectric materials in and surrounding slot element 74. Antenna currents may flow between feed terminals 70 and 72 around perimeter P of slot element 74. In the example where slot length L is much greater than slot width W, the length of antenna 40-1 will tend to be about half of the length of other types of antennas such as inverted-F antennas configured to handle signals at the same frequency. Given equal antenna volumes, antenna 40-1 may therefore be able to handle signals at approximately twice the frequency of other antennas such as inverted-F antennas, for example.

Antenna feed 62 may be coupled across slot element 74 at a location between opposing edges 76 and 78 of slot element 74. For example, antenna feed 62 may be located at a distance 80 from edge 76 of slot element 74. Distance 80 may be adjusted to match the impedance of antenna 40-1 to the impedance of transmission line 50 (FIG. 3). For example, the antenna current flowing around slot element 74 may experience an impedance of zero at edges 76 and 78 of slot element 74 (e.g., a short circuit impedance) and an infinite (open circuit) impedance at the center of slot element 74 (e.g., at a fundamental frequency of the slot). Antenna feed 62 may be located between the center of slot element 74 and edge 76 at a location where the antenna current experiences an impedance that matches the impedance of transmission line 50, for example (e.g., distance 80 may be between 0 and ¼ of the wavelength of operation of antenna 40-1).

The example of FIG. 4 is merely illustrative. In general, slot element 74 may have any desired shape (e.g., where the perimeter P of slot element 74 defines radiating characteristics of antenna 40-1). For example, slot element 74 may have a meandering shape with different segments extending in different directions, may have straight and/or curved edges, etc. Conductor 82 may be formed from any desired conductive electronic device structures. For example, conductor 82 may include conductive traces on printed circuit boards or other substrates, sheet metal, metal foil, conductive structures associated with display 14 (FIG. 1), conductive portions of housing 12 (e.g., conductive sidewalls 12W of FIG. 1), or other conductive structures within device 10. In one suitable arrangement, different sides (edges) of slot element 74 are defined by different conductive structures. For example, one side of slot element 74 may be formed from conductive sidewalls 12W whereas the other side of slot element 74 is formed from conductive structures associated with display 14.

Figure 5:
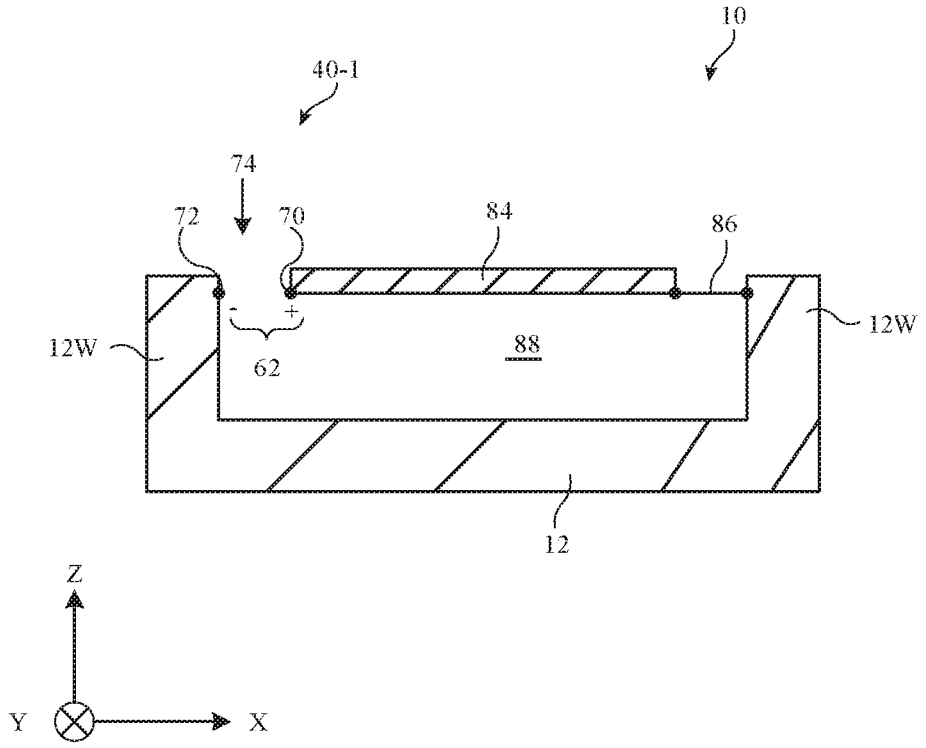
FIG. 5 is a cross-sectional side view of an illustrative antenna formed using conductive display structures and conductive electronic device housing structures in accordance with some embodiments.

FIG. 5 is a simplified cross-sectional side view of device 10 showing how antenna 40-1 may be formed from conductive structures associated with display 14 and conductive sidewalls 12W. As shown in FIG. 5, antenna 40-1 may include conductive display structures 84 coupled to an antenna feed such as antenna feed 62. Positive antenna feed terminal 70 of antenna feed 62 may be coupled to conductive display structures 84. Ground antenna feed terminal 72 of antenna feed 62 may be coupled to an antenna ground (e.g., to conductive sidewalls 12W of housing 12).

In this way, housing 12 and conductive display structures 84 may form conductor 82 of FIG. 4 and may define the edges of slot element 74 for antenna 40-1 (where the perimeter of slot element 74 extends parallel to the X-Y plane of FIG. 5). As shown by FIG. 5, slot element 74 may separate conductive display structures 84 from conductive sidewalls 12W and may be bridged by antenna feed 62. Slot element 74 may surround one or more lateral sides of conductive display structures 84 (e.g., in the X-Y plane of FIG. 5).

Housing 12 and conductive display structures 84 may define an interior cavity or volume 88 within device 10. Additional device components may be mounted within volume 88. Antenna feed 62 may be coupled to transceiver circuitry 52 by a transmission line such as a coaxial cable or a flexible printed circuit transmission line (e.g., transmission line 50 of FIG. 3).

Conductive display structures 84 may, for example, include portions of display 14 (FIG. 1) such as metal portions of a frame or assembly of display 14, touch sensor electrodes within display 14, portions of a near field communications antenna embedded within display 14, ground plane structures within display 14, a metal back plate for display 14, or other conductive structures on or in display 14. Conductive display structures 84 may sometimes be referred to herein as display module structures 84.

Conductive display structures 84 may be coupled to an antenna ground (e.g., conductive sidewall 12W) by conductive interconnect path 86 (e.g., across a portion of slot element 74 extending between conductive display structures 84 and conductive sidewalls 12W). Conductive interconnect path 86 may include conductive structures that are directly connected to conductive display structures 84, may include conductive structures that are capacitively coupled to (but not in contact with) conductive display structures 84 (e.g., while still spanning part of slot element 74 and electrically shorting conductive display structures 84 to housing 12), and/or may include conductive structures that are not coupled to conductive display structures 84 (e.g., while still spanning part of slot element 74 and being held at a ground potential, thereby serving to electrically define the perimeter of slot element 74 in the X-Y plane of FIG. 5). In the example of FIG. 5, conductive housing 12 defines a rear wall of device 10 that opposes conductive display structures 84 (e.g., volume 88 may be partially defined by a rear wall of device 10). This is merely illustrative. If desired, some or all of the rear wall of device 10 may be formed from dielectric materials and volume 88 may be defined by other components such as one or more printed circuit boards within device 10.

Antenna 40-1 may be used to transmit and receive radio-frequency signals in WLAN and/or WPAN bands at 2.4 GHz and 5.0 GHz, in cellular telephone bands between 1.7 GHz and 2.2 GHz and between 2.2 GHz and 2.7 GHz, in an ultra-wideband frequency band between about 5 GHz and 8.5 GHz, in satellite navigation bands at 1.5 GHz, and/or other desired frequency bands. The 2.4 GHz frequency band may include any desired WLAN and/or WPAN frequency bands at frequencies between 2.4 GHz and 2.5 GHz, for example. The 5.0 GHz frequency band may include any desired WLAN frequency bands at frequencies between 4.9 GHz and 5.9 GHz, for example. Additional antennas may also be provided in device 10 to handle these frequency bands and/or other frequency bands. The configuration for antenna 40-1 of FIG. 5 is merely illustrative.

Figure 6:
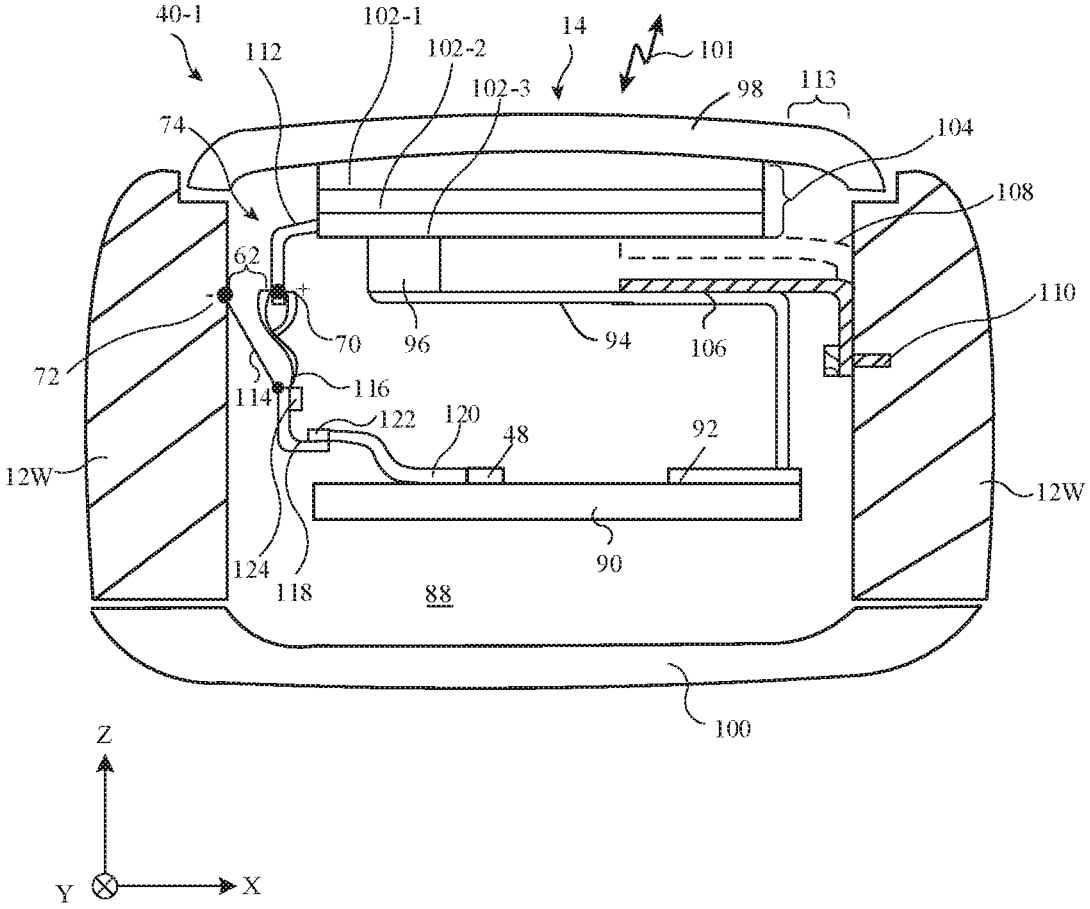
FIG. 6 is a cross-sectional side view of an illustrative electronic device having an antenna of the type shown in FIG. 5 in accordance with some embodiments.

FIG. 6 is a cross-sectional side view of device 10 (e.g., taken across lines A1-A1' in FIG. 1) showing how antenna 40-1 and conductive interconnect path 86 of FIG. 5 may be implemented within device 10. As shown in FIG. 6, device 10 may have conductive sidewalls 12W that extend from the rear face to the front face of device 10. Housing 12 may include a dielectric rear housing wall such as dielectric rear housing wall 100. Display 14 may be formed at the front face of device 10 whereas dielectric rear housing wall 100 is formed at the rear face of device 10. Conductive sidewalls 12W may be coupled to ground antenna feed terminal 72 of antenna feed 62. Display 14 may include a display cover layer 98 and a display module 104 under display cover layer 98.

Display module 104 may include conductive components that are used in forming conductive display structures 84 of antenna 40-1 (FIG. 5). The conductive components in display module 104 may, for example, have planar shapes (e.g., planar rectangular shapes, planar circular shapes, etc.) and may be formed from metal and/or other conductive material that carries antenna currents. The thin planar shapes of these components and the stacked configuration of FIG. 6 may, for example, capacitively couple these components to each other so that they may operate together at radio frequencies to form conductive display structures 84 of FIG. 5 (e.g., to effectively/electrically form a single conductor).

The components that form conductive display structures 84 may include, for example, planar components on one or more layers 102 in display module 104 (e.g., a first layer 102-1, a second layer 102-2, a third layer 102-3, or other desired layers). As one example, layer 102-1 may form a touch sensor for display 14, layer 102-2 may form a display panel (sometimes referred to as a display, display layer, or pixel array) for display 14, and layer 102-3 may form a near-field communications antenna for device 10 and/or other circuitry for supporting near-field communications (e.g., at 13.56 MHz). Layer 102-1 may include a capacitive touch sensor and may be formed from a polyimide substrate or other flexible polymer layer with transparent capacitive touch sensor electrodes (e.g., indium tin oxide electrodes), for example. Layer 102-2 may include an organic light-emitting diode display layer or other suitable display layer. Layer 102-3 may be formed from a flexible layer that includes a magnetic shielding material (e.g., a ferrite layer or other magnetic shielding layer) and that includes loops of metal traces. If desired, a conductive back plate, metal shielding cans or layers, and/or a conductive display frame may be formed under and/or around layer 102-3 and may provide structural support and/or a grounding reference for the components of display module 104. Display module 104 may sometimes be referred to herein as display assembly 104.

Conductive material in layers 102-1, 102-2, 102-3, a conductive back plate for display 14, conductive shielding layers, conductive shielding cans, and/or a conductive frame for display 14 may be used in forming conductive structures 84 defining edges of slot element 74 for antenna 40-1. This and/or other conductive material in display 14 used to form conductive display structures 84 may be coupled together using conductive traces, vertical conductive interconnects or other conductive interconnects, and/or via capacitive coupling, for example.

Antenna 40-1 may be fed using antenna feed 62. Positive antenna feed terminal 70 of antenna feed 62 may be coupled to display module 104 and therefore conductive display structures 84 (e.g., to near-field communications layer 102-3, display layer 102-2, touch layer 102-1, a metal back plate for display module 104, and/or a metal display frame for display module 104). Ground antenna feed terminal 72 of antenna feed 62 may be coupled to an antenna ground in device 10 (e.g., conductive sidewall 12W).

As shown in FIG. 6, device 10 may include printed circuit board structures such as printed circuit board 90. Printed circuit board 90 may be a rigid printed circuit board, a flexible printed circuit board, or may include both flexible and rigid printed circuit board structures. Printed circuit board 90 may sometimes be referred to herein as main logic board 90 or logic board 90. Electrical components such as transceiver circuitry 48, display interface circuitry 92, and other components may be mounted to logic board 90. If desired, one or more additional antennas, coil 50 (FIG. 2), and/or sensor circuitry or other input-output devices may be interposed between logic board 90 and dielectric rear housing wall 100 (e.g., for conveying wireless signals through dielectric rear housing wall 100). Antenna currents for antenna 40-1 may be conveyed through conductive sidewalls 12W and display module 104 (i.e., conductive display structures 84 of FIG. 5) around the perimeter of slot element 74 (e.g., in the X-Y plane of FIG. 6). Corresponding radio-frequency signals may be conveyed through display cover layer 98, as shown by arrow 101.

Display module 104 may include one or more display connectors such as connectors 96. Connectors 96 may be coupled to one or more printed circuits 94. Printed circuits 94 may include flexible printed circuits (sometimes referred to herein as display flexes 94), rigid printed circuit boards, or traces on other substrates if desired. Connectors 96 may convey signals between layers 102 of display module 104 and display interface circuitry 92 on logic board 90 via display flexes 94.

As an example, display module 104 may include a first connector 96 that conveys touch sensor signals from layer 102-1 to display interface circuitry 92 over a first display flex 94, a second connector 96 that conveys display data (e.g., image data) from display interface circuitry 92 to display layer 102-2 over a second display flex 94 (e.g., layer 102-2 may emit light corresponding to the display data), and a third connector 96 that conveys near field communications signals to and/or from layer 102-3 over a third display flex 94. Connectors 96 may include conductive contact pads, conductive pins, conductive springs, conductive adhesive, conductive clips, solder, welds, conductive wires, and/or any other desired conductive interconnect structures and/or fasteners for conveying data associated with display module 104 between display module 104 and circuitry on logic board 90 or elsewhere in device 10.

Transceiver circuitry 48 may be coupled to antenna feed 62 of antenna 40-1 over radio-frequency transmission line 50 (FIG. 3). Radio-frequency transmission line 50 may include conductive paths in flexible printed circuit 120 and dielectric support structure 118. Dielectric support structure 118 may, for example, be formed from plastic or other dielectric materials, from a rigid printed circuit board, from a flexible printed circuit, etc. Conductive paths associated with radio-frequency transmission line 50 in flexible printed circuit 120 may be coupled to conductive paths associated with radio-frequency transmission line 50 in dielectric support structure 118 over radio-frequency connector 122.

Ground signal line 54 in transmission line 50 (FIG. 3) may be coupled to ground antenna feed terminal 72 over path 114 (e.g., ground traces in dielectric support structure 118 may be coupled to ground antenna feed terminal 72 over path 114). Path 114 may include conductive wires, conductive adhesive, conductive fasteners such as screws, conductive pins, conductive clips, conductive brackets, solder, welds, and/or any other desired conductive interconnect structures. Signal line 52 of transmission line 50 (FIG. 3) may be coupled to positive antenna feed terminal 70 of antenna 40-1 over conductive clip 116 (e.g., signal traces in dielectric support structure 118 may be coupled to positive antenna feed terminal 70 over conductive clip 116). One or more components such as components 124 may be mounted to dielectric support structure 118 if desired. Components 124 may include amplifier circuitry, impedance matching circuitry, or any other desired components.

If desired, a conductive tab or blade such as conductive tab 112 may be coupled to the conductive structures of display module 104 (e.g., conductive structures in layers 102, a conductive back plate, a conductive frame, conductive shielding cans or layers, and/or other conductive display structures 84 in display module 104). Clip 116 may mate with tab 112 to form an electrical connection between transmission line 50 and positive antenna feed terminal 70 (e.g., positive antenna feed terminal 70 may be located on tab 112 when clip 116 is attached to tab 112). Clip 116 may, for example, be a tulip clip or other clip that has prongs or other structures that exerts pressure towards tab 112, thereby ensuring that a robust and reliable electrical connection is held between tab 112 and clip 116 over time.

When configured in this way, antenna currents may be conveyed over antenna feed 62 and may begin to flow around the perimeter of slot element 74 (e.g., in the X-Y plane of FIG. 6). In order to help define the lateral (elongated) length L of slot element 74, conductive interconnect paths such as conductive interconnect path 86 of FIG. 5 may span gap 113 between a given side of display module 104 and an adjacent conductive sidewall 12W. In the example of FIG. 6, conductive interconnect path 86 of FIG. 5 is implemented using conductive interconnect structures 106. Conductive interconnect structures 106 may sometimes be referred to herein as conductive grounding structures 106 or grounding structures 106.

In one suitable arrangement, conductive interconnect structures 106 may be shorted to (e.g., in direct contact with) the conductive material in display module 104, as shown by dashed lines 108. For example, conductive interconnect structures 106 may be shorted to conductive material within layer 102-1, layer 102-2, or layer 102-3, a conductive frame of display module 104, a conductive back plate of display module 104, shielding structures in display module 104, and/or other conductive material in display module 104 that are used to form conductive display structures 84 of antenna 40-1.

If desired, conductive adhesive or conductive fastening structures such as pins, solder, welds, springs, screws, clips, brackets, and/or other fastening structures may be used to ensure that conductive interconnect structures 106 are held in contact with conductive material in display module 104. Conductive interconnect structures 106 may extend across gap 113 and may be shorted to conductive sidewall 12W. Conductive interconnect structures 106 may be held into contact with conductive sidewall 12W using conductive adhesive, pins, springs, screws, clips, brackets, solder, welds, and/or other structures if desired. In the example of FIG. 6, a conductive screw 110 fastens conductive interconnect structures 106 to conductive sidewall 12W and serves to electrically short conductive interconnect structures 106 and thus conductive display structures 84 to conductive sidewall 12W.

When configured in this way, conductive interconnect structures 106 may define a portion of the perimeter of slot element 74 in antenna 40-1 (e.g., in the X-Y plane of FIG. 6), thereby partially defining length L of slot element 74 (FIG. 4). In addition, conductive interconnect structures 106 (e.g., conductive interconnect path 86 as shown in FIG. 5) may form a short circuit path between conductive material in display module 104 and conductive sidewall 12W (e.g., antenna currents for antenna 40-1 may flow over conductive interconnect structures 106 between display module 104 and conductive sidewall 12W). Shorting display module 104 to conductive sidewall 12W across gap 113 may serve to mitigate excessively strong electric fields that would otherwise be present in the vicinity of gap 113 due to the location of antenna feed 62 on a different side of display module 104. This may serve to optimize antenna efficiency relative to scenarios where display module 104 is completely isolated from conductive sidewalls 12W, for example.

This example is merely illustrative. Conductive interconnect structures 106 need not directly contact display module 104. In another suitable arrangement, conductive interconnect structures 106 may span gap 113 without directly contacting display module 104 (e.g., as shown in FIG. 6). In this scenario, conductive interconnect structures 106 may be electrically shorted to one or more display flexes 94 (e.g., to ground conductors or other conductive material in display flexes 94). For example, conductive interconnect structures 106 may be electrically shorted to display flexes 94 using conductive adhesive or conductive fastening structures such as pins, solder, welds, springs, screws, clips, brackets, and/or other structures that ensure that conductive interconnect structures 106 are held in contact with display flexes 94.

If desired, conductive interconnect structures 106 may be located sufficiently close to the conductive material in display module 104 so as to effectively short conductive display structures 84 to a grounding structure such as sidewall 12W (e.g., at radio-frequencies handled by antenna feed 62). For example, conductive interconnect structures 106 may be capacitively coupled to conductive display structures 84 in display module 104 and antenna currents associated with antenna 40-1 may flow between display module 104 and conductive sidewall 12W over conductive interconnect structures 106 (e.g., via capacitive coupling). Conductive interconnect structures 106 need not be shorted to display flexes 94 in this scenario, if desired. Conductive interconnect structures 106 may directly contact one, both, or neither of display module 104 and display flexes 94. Conductive interconnect structures 106 may be capacitively coupled to one, both, or neither of display module 104 and display flexes 94.

In another suitable arrangement, conductive interconnect structures 106 may be located far enough away from display module 104 so that conductive interconnect structures 106 are not capacitively coupled to the conductive material in display module 104. In this scenario, because conductive interconnect structures 106 are held at a ground potential (e.g., because conductive interconnect structures 106 short ground structures in display flexes 94 to the grounded conductive sidewall 12W), conductive interconnect structures 106 may still electrically define edges of slot element 74 despite not actually being in contact with or capacitively coupled to conductive display structures 84 in display module 104, thereby helping to define length L of slot element 74 (FIG. 4).

The example of FIG. 6 is merely illustrative. In general, conductive sidewalls 12W, cover layer 98, and dielectric rear housing wall 100 may have any desired shapes. Additional components may be formed within volume 88 if desired. A substrate or other support structure may be interposed between logic board 90 and display flexes 94 if desired (e.g., to hold display flexes 94 in place). Other arrangements may be used if desired. If desired, flexible printed circuit 120 may be coupled to antenna feed 62 without dielectric support structure 118 or flexible printed circuit 120 may be omitted (e.g., dielectric support structure 118 may be coupled directly to transceiver circuitry 48). Other transmission line and feeding structures may be used if desired.

Figure 7:
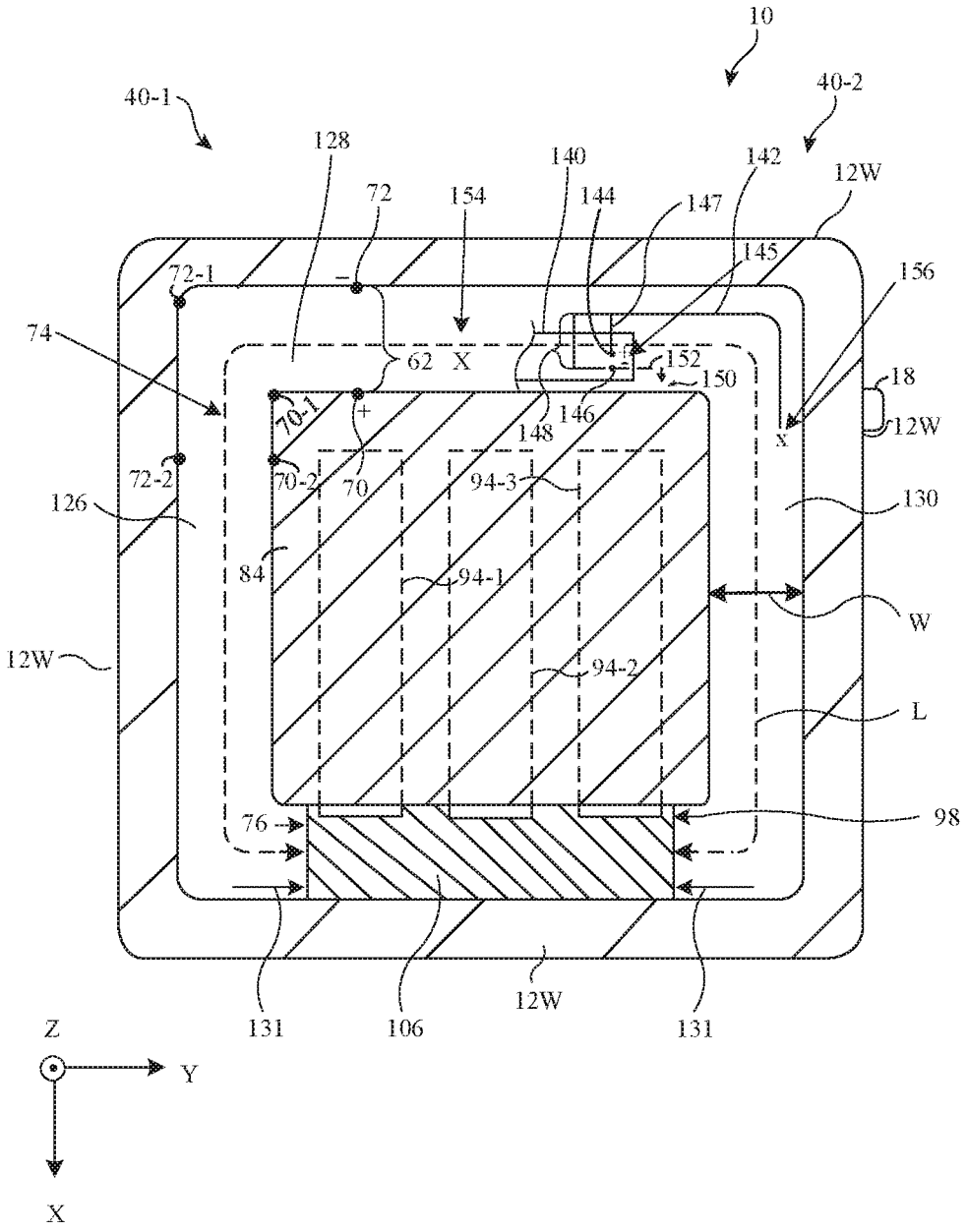
FIG. 7 is a top-down view of an illustrative electronic device antenna having an antenna resonating element in a slot element defined by conductive display structures in accordance with some embodiments.

FIG. 7 is a top-down view showing how slot element 74 of antenna 40-1 may follow a meandering path around display module 104 and may have edges defined by display module 104, conductive sidewalls 12W, and conductive interconnect structures 106. The plane of the page in FIG. 7 may, for example, lie in the X-Y plane of FIGS. 5 and 6. In the example of FIG. 7, display cover layer 98 of FIG. 6 is not shown for the sake of clarity.

As shown in FIG. 7, slot element 74 of antenna 40-1 may follow a meandering path and may have edges defined by different conductive electronic device structures. For example, slot element 74 may have a first set of edges (e.g., outer edges) defined by conductive sidewalls 12W and a second set of edges (e.g., inner edges) defined by conductive structures such as conductive display structures 84. Conductive display structures 84 may, for example, include conductive portions of display module 104 (FIG. 6) such as metal portions of a frame or assembly of display 14, touch sensor electrodes within layer 102-1, pixel circuitry within layer 102-2, portions of a near field communications antenna embedded within layer 102-3, ground plane structures within display 14, a metal back plate for display 14, or other conductive structures on or in display 14.

In the example of FIG. 7, slot element 74 follows a meandering path and has a first segment 126 extending between the left conductive sidewall 12W and conductive display structures 84, a second segment 128 extending between the top conductive sidewall 12W and conductive display structures 84, and a third segment 130 extending between the right conductive sidewall 12W and conductive display structures 84. Segments 126 and 130 may extend along parallel longitudinal axes. Segment 128 may extend between ends of segments 126 and 130 (e.g., perpendicular to the longitudinal axes of segments 126 and 130). In this way, slot element 74 may be an elongated slot element that extends between conductive display structures 84 and multiple conductive sidewalls 12W (e.g., to maximize the length of slot element 74 for covering relatively low frequency bands such as satellite navigation communications bands and low band cellular telephone communications bands).

Antenna 40-1 may be fed using antenna feed 62 coupled across width W of slot element 74. In the example of FIG. 7, antenna feed 62 is coupled across segment 128 of slot element 74. This is merely illustrative and, in general, antenna feed 62 may be coupled across any desired portion of slot element 74. As examples, antenna feed 62 may be coupled across a corner portion of slot element 74 (e.g., the perpendicular corner at which segments 126 and 128 are joined), may be coupled across segment 126 of slot element 74, or may be coupled across any other portion of slot element 74.

Ground antenna feed terminal 72 of antenna feed 62 may be coupled to a given conductive sidewall 12W and positive antenna feed terminal 70 of antenna feed 62 may be coupled to conductive display structures 84. This is merely illustrative. If desired, ground antenna feed terminal 72 may be coupled to conductive display structures 84 and positive antenna feed terminal 70 may be coupled to conductive sidewall 12W. In the example of FIG. 7, antenna feed terminals 70 and 72 may be coupled across segment 128 of slot element 74. If desired, antenna feed terminals 70 and 72 may be respectively coupled at locations 70-1 and 72-1 (in the example of antenna feed 62 being formed across the corner portion of slot element 74) or locations 70-2 and 72-2 (in the example of antenna feed 62 being formed across segment 126 of slot element 74).

When configured based on conductive sidewalls 12W, conductive display structures 84, and conductive interconnect structures 106, slot element 74 may have length L defined by the cumulative lengths of segments 126, 128, and 130. The perimeter of slot element 74 may be defined by the sum of the lengths of the edges of these segments. Antenna 40-1 may, for example, exhibit response peaks when the perimeter of slot element 74 is approximately equal to the effective wavelength of operation of the antenna (e.g., the wavelength after accounting for dielectric effects associated with the materials in device 10). Antenna feed 62 may convey antenna currents around the perimeter of slot element 74 (e.g., over conductive sidewalls 12W and conductive display structures 84). The antenna currents may generate corresponding wireless signals that are transmitted by antenna 40-1 or may be generated in response to corresponding wireless signals received by antenna 40-1 from external equipment.

Conductive interconnect structures 106 may define opposing edges 76 and 78 of slot element 74 and may serve to effectively define the length L of slot element 74. Conductive interconnect structures 106 may be held at a ground potential and/or may short conductive display structures 84 to conductive sidewall 12W. When configured in this way, antenna currents conveyed by antenna feed 62 may experience a short circuit impedance at ends 76 and 78 of slot element 74 (over conductive interconnect structures 106).

If desired, the location and width of conductive interconnect structures 106 may be adjusted (e.g., as shown by arrows 131) to extend or contract the length L of slot element 74 (e.g., so that slot element 74 radiates at desired frequencies). In one suitable arrangement, antenna 40-1 may be provided with suitable impedance matching circuitry and a selected length L so that slot element 74 radiates in a first frequency band (e.g., a first frequency band from 1.5 GHz to 2.2 GHz that covers WLAN, WPAN, satellite navigation, cellular midband, and/or some cellular high band frequencies), a second frequency band (e.g., a second frequency band from 2.2 GHz to 3.0 GHz that covers WLAN/WPAN frequencies), and a third frequency band (e.g., a third frequency band from 5.0 to 8.0 GHz that covers WLAN frequencies and UWB frequencies). One or more of these frequency bands may be covered by harmonic modes of slot element 74 if desired. Conductive interconnect structures 106 may be directly connected to conductive display structures 84 (e.g., as shown by dashed lines 108 of FIG. 6), may be indirectly coupled to conductive display structures 106 via capacitive coupling, or may be separated from conductive display structures 106 (e.g., conductive interconnect structures 106 need not be in contact with conductive display structures 84 but still electrically define part of the perimeter of slot element 74).

In scenarios where conductive interconnect structures 106 are absent from device 10, excessively strong electric fields may be generated between conductive display structures 84 and the conductive sidewall 12W at the side of device 10 opposite to antenna feed 62. These fields may limit the overall antenna efficiency of antenna 40-1. However, the presence of conductive interconnect structures 106 may effectively form a short circuit between conductive display structures 84 and conductive sidewall 12W. This may, for example, configure housing 12 and conductive display structures 84 to electrically behave as a single metal body, mitigating excessive electric fields at the side of device 10 opposing antenna feed 62. In this way, antenna 40-1 may operate with greater antenna efficiency relative to scenarios where conductive interconnect structures 106 are absent from device 10. The presence of conductive interconnect structures 106 may allow for the width W of slot element 74 and the thickness of device 10 to be reduced given equal antenna efficiencies relative to scenarios where conductive interconnect structures 106 are not formed within device 10, for example.

Conductive interconnect structures 106 may include any desired conductive structures such as conductive adhesive (e.g., conductive tape), conductive fasteners (e.g., conductive screws or clips such as blade clips), conductive pins, solder, welds, conductive traces on flexible printed circuits, metal foil, stamped sheet metal, integral device housing structures, conductive brackets, conductive springs, and/or any other desired structures for defining the perimeter of slot element 74 and/or effectively forming an electrical short circuit path between conductive display structures 84 and housing 12.

As shown in FIG. 7, multiple display flexes 94 may be formed under conductive display structures 84 (e.g., a first display flex 94-1, a second display flex 94-2, and a third display flex 94-3). Display flex 94-3 may be electrically coupled to layer 102-3 (FIG. 6), display flex 94-2 may be electrically coupled to layer 102-2, and display flex 94-1 may be electrically coupled to layer 102-1. The ends of display flexes 94 closest to antenna feed 62 may be coupled to conductive display structures 84, for example. The opposing ends of display flexes 94 may be coupled to display interface circuitry 92 (FIG. 6). Display flex 94-3 may convey near field communications signals between layer 102-3 and other communications circuitry on logic board 90. Display flex 94-2 may convey image data between layer 102-2 and display circuitry on logic board 90. Display flex 94-1 may convey touch sensor data between layer 102-1 and control circuitry on logic board 90. Conductive interconnect structures 106 may electrically short grounded portions of display flexes 94-1, 94-2, and 94-3 to conductive sidewalls 12W if desired.

The example for the configuration of antenna 40-1 in FIG. 7 is merely illustrative. Slot element 74 may have a uniform width W along length L or may have different widths along length L. If desired, width W may be adjusted to tweak the bandwidth of antenna 40-1. As an example, width W may be between 0.5 mm and 1.0 mm. Slot element 74 may have other shapes if desired (e.g., shapes with more than three segments extending along respective longitudinal axes, fewer than three segments, curved edges, etc.).

Because the dimensions of slot element 74 are set by features of device 10 that serve other purposes, those features may constrain the dimensions of slot element 74 and consequently the frequency coverage of antenna 40-1. As an example, due to the length of slot element 74 being defined by sidewalls 12W and conductive display structure 84, antenna 40-1 may more readily to radiate at lower frequencies given effective elongated length of slot element 74. Additional antenna elements such as tuning element for operating in harmonic modes may be required for antenna 40-1 to radiate at higher frequencies of interest (e.g., in an UWB band). However, this can lead to bulky additional antenna elements for antenna 40-1 being placed at undesirable or otherwise impossible locations that overlap with, interfere with, and/or are interfered by other electronic device components. As such, it may be desirable to provide an electronic device having compact antenna structures operable to provide frequency coverage at high frequencies (as wells as low frequencies) to provide a high bandwidth antenna system.

Still referring to FIG. 7, device 10 may include antenna structures that are operable to provide frequency coverage at relatively low frequencies (e.g., below 5 GHz, below 3 GHz, below 2.5 GHz, etc.) and relatively high frequencies (e.g., above 5 GHz, above 3 GHz, above 2.5 GHz, etc.). In particular, in addition to including antenna 40-1 (e.g., associated with slot antenna resonating element 74), device 10 may also include an antenna such as antenna 40-2. Antenna 40-2 may include an antenna resonating (radiating) element such as antenna resonating element arm 142 aligned with (e.g., disposed within) slot element 74 (e.g., within slot element 74 in the top-down view of FIG. 7). As such, antenna resonating element arm 142 may be interposed between conductive sidewalls 12W and conductive display structures 84. The example of the antenna resonating element being an antenna resonating element arm is merely illustrative. If desired, other antenna resonating structures may be used. Antenna resonating element arm 142 may sometimes be referred to as antenna resonating element 142, antenna radiating element 142, and antenna radiating element arm 142.

In the example of FIG. 7, antenna resonating element arm 142 may be coupled to a printed circuit such as printed circuit 140, sometimes referred to as a printed circuit board. Printed circuit 140 may be a flexible printed circuit board, a rigid printed circuit board, or a printed circuit board having combination of flexible and rigid structures. One or more antenna elements for antenna 40-2 may formed on printed circuit 140.

Antenna 40-2 may be an inverted-F antenna having return path 148 and feed path 147 (e.g., a feed leg) coupled in parallel to antenna resonating element arm 142. The length of resonating element arm 142 may be selected so that antenna 40-2 radiates (or resonates) at desired operating frequencies. As an example, the length of resonating element arm 142 may be equal to one-quarter of the effective wavelength corresponding to a desired operating frequency for antenna 40-2. The effective wavelength may be equal to a freespace wavelength multiplied by a constant value that is determined by the dielectric materials in and surrounding antenna resonating element arm 142. Antenna 40-2 may also exhibit resonances at harmonic frequencies.

Return path 148 may be coupled to a grounding structure formed on printed circuit 140 and/or provided separately from printed circuit 140 via conductive path 152. As an example, printed circuit 140 may include conductive traces or other conductive portions that form at least a portion of an antenna ground for antenna 40-2. The conductive ground portions on printed circuit 140 may be coupled to other grounding structures such as conductive sidewalls 12W that form an additional portion of antenna ground for antenna 40-2. The antenna ground for antenna 40-1 may also form the antenna ground for antenna 40-1. Antenna 40-2 may include antenna feed 145 coupled across feed path 147 and the antenna ground for antenna 40-2 (e.g., the conductive ground portions of printed circuit 140, conductive sidewalls 12W, etc.). One or more of these antenna ground structures may be represented by antenna ground 150 in FIG. 7. Antenna feed 145 may include a ground antenna feed terminal such as antenna feed terminal 146 coupled to the antenna ground and a positive antenna feed terminal such as antenna feed terminal 144 coupled to feed path 147.

In the example of FIG. 7, printed circuit 140 may be disposed in segment 128 of slot element 74 and may extend along segment 128 to provide antenna resonating element arm 142 at a desirable location within slot element 74. Antenna resonating element arm 142 may have a first portion disposed in segment 128 of slot element 74 and a second portion disposed in segment 130 of slot element 74. Antenna resonating element arm 142 may therefore include a bend such as a perpendicular bend to accommodate for the bend in slot element 74 (between segments 128 and 130).

As shown in the top-down view of FIG. 7, antenna resonating element arm 142 may lie within slot element 74. This may include configurations in which antenna resonating element arm 142 lies in the same X-Y plane as conductive display structures 84 and sidewalls 12W that define slot element 74. This may also include configurations in which antenna resonating element arm 142 lies in a different X-Y plane than that in which conductive display structure 84 and sidewalls 12W lie (e.g., that in which slot 74 lies). Regardless of which configuration, antenna resonating element arm 142 may remain aligned with slot element 74 (as shown in the top-down view of FIG. 7).

Antenna resonating element arm 142 may have a first (proximal) end at printed circuit 140 in slot segment 128, may extend towards and into slot segment 130, and may have a second (distal) end in slot segment 130. The antenna resonating element arm 142 may extend away from antenna feed 62 for antenna 40-1 (e.g., the proximal end of antenna resonating element arm 142 may be interposed between the distal end of antenna resonating element arm 142 and antenna feed 62). Configured in this manner, antenna resonating element arm 132 may exhibit a peak electric field at location 156 (at the distal end of antenna resonating element arm 132) during operation. Because the peak electrical field location for slot antenna resonating element 74 is situated at location 154, by providing the distal end of antenna resonating element arm 142 away from location 154 (e.g., at location 156), antennas 40-1 and 40-2 may have satisfactory electromagnetic isolation with respect to each other.

The example for the configuration of antenna 40-2 in FIG. 7 is merely illustrative. If desired, antenna 40-2 may instead be formed from a monopole antenna element, a dipole antenna element, or any other suitable antenna structure. Depending on the configuration of antenna 40-1 (e.g., the position of peak electric field for antenna 40-1), antenna 40-2 may be situated in a different location within slot element 74. As examples, antenna resonating element 142 for antenna 40-2 may be disposed, entirely within slot segment 126, entirely within slot segment 128, entirely within slot segment 130, within two or more portions of slot segments 126, 128, and 130, etc. If desired, printed circuit 140 may be formed at any suitable location to place antenna resonating element arm 142 at a desirable location (e.g., within one or more of the slot segments). If desired, antenna 40-2 may be implemented without printed circuit 140, and antenna resonating element arm 142 may optionally be coupled directly to transmission line structures or other feed structures (e.g., without intervening printed circuit 140).

In the example of FIG. 7, the distal end of antenna resonating element arm 142 may be disposed adjacent to button 18. This is merely illustrative. If desired, the distal end of antenna resonating element arm 142 may extend past button 18, may terminate before reaching button 18, may terminate at other components in device 10, or may terminate at any suitable location.

Figure 8:
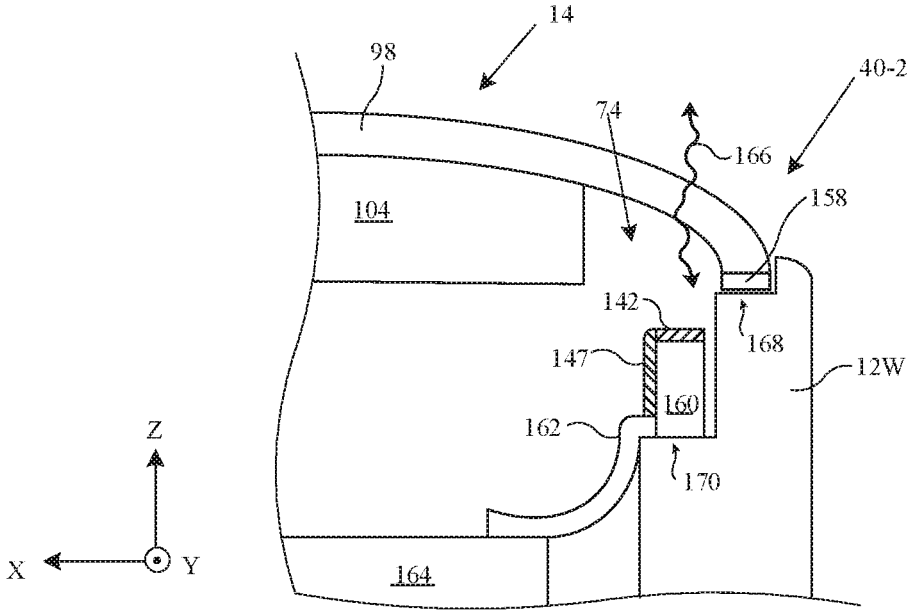
FIG. 8 is a cross-sectional side view of an illustrative electronic device having an antenna of the type shown in FIG. 7 in accordance with some embodiments.

FIG. 8 is a partial cross-sectional side view of device 10 (e.g., taken across lines A2-A2' in FIG. 1) showing how antenna 40-2 (FIG. 7) may be implemented within device 10. As shown in FIG. 8, display module 104 may be coupled to (e.g., mounted to) display cover layer 98. One or more conductive layers in display module 104 may form conductive display structure 84 (FIG. 7), which in combination with sidewall 12W may define slot element 74.

Sidewall 12W may include have two ledges (sometimes referred to as steps or extensions) such as ledges 168 and 170, on which components in device 10 may be disposed. Display cover layer 98 may be coupled to ledge 168 via attachment structure 158. Attachment structure 158 may include adhesive, pins, springs, screws, clips, brackets, solder, welds, gaskets, and/or other attachment structures. If desired, attachment structure 158 may include sensor components such as a force sensor configured to detect and/or measure a force being applied to display cover layer 98.

Antenna support structure 160 may be formed on ledge 170 of sidewall 12W. Antenna support structure 160, which may sometimes be referred to as support structure 160, may include a molded frame structure (e.g., a molded plastic), a foam structure, a dielectric support structure, a structure on which conductive traces may be suitably formed, and/or a structure suitable for supporting conductive traces for antenna elements, as examples. Antenna resonating element arm 142 may be formed on antenna support structure 160. Additional antenna elements such as feed path 147, a return path, an antenna ground, and/or other antenna elements, may also be formed on support structure 160. These additional antenna elements may be formed on one or more sides of support structure 160 (e.g., formed on a side of support structure 160 that is adjacent to the side of support structure 160 on which antenna resonating element arm 142 is formed).

Antenna resonating element arm 142 and additional antenna elements may be formed from metal coating layers, portions of other metal members for other components in device 10, metal foil, wires, and/or other conductive material formed on support structure 160. As an example, the conductive material for antenna resonating element arm 142 (and/or any other antenna elements) may be formed on antenna support structure 160 using laser direct structuring (LDS). If desired, the conductive material for antenna elements may be formed on and/or placed onto support structure 160 in any other suitable manner.

Printed circuit 140 (in FIG. 7) may be adjacent to or in relatively close proximity to antenna support structure 160 such that antenna elements on printed circuit 140 (e.g., an antenna ground, antenna feed, etc.) may be coupled to antenna elements on antenna support structure 160 (e.g., antenna resonating element arm 142) to form antenna 40-2. As examples, antenna support structure 160 may be mounted directly on printed circuit 140, may be attached to printed circuit 140 by screws, adhesive, connectors, and/or other attachment structures, may be mounted to an interposing structure or component that is shared by printed circuit 140, may be separated from printed circuit 140 but disposed a suitable distance apart, may have a portion that is supported by and/or mounted to printed circuit 140 and another portion mounted to and/or hangs over other components, and/or may be positioned in any other suitable manner with respect to printed circuit 140.

As shown in FIG. 8, antenna resonating element arm 142 may be formed on the top surface opposing the bottom surface to which ledge 170 is coupled. By configuring antenna resonating element arm 142 in such a manner, antenna resonating element arm 142 may be aligned with slot element 74 in the vertical direction (parallel to the Z-axis). Antenna 40-2 may therefore radiate through slot element 74, through display cover layer 98, and through a front face of device 10 (as shown by arrow 166).

In the example of FIG. 8, antenna resonating element arm 142 may be formed below (e.g., in the negative X direction from) a lateral opening (in the X-Y plane) that form a portion of slot element 74 that is laterally adjacent to display module 104. This is merely illustrative. If desired, antenna resonating element arm 142 may be formed at or above the lateral opening that form the portion of slot element 74 adjacent to display module 104. In other words, the height of support structure 160 may be increased along the Z-axis and/or the thickness (in the Z-axis direction) of the conductive traces forming antenna resonating element arm 142 may increase to provide extend antenna resonating element arm 142 vertically (in the positive Z direction) to a position that is laterally adjacent to display module 104 (e.g., in the same X-Y plane as at least a portion of display module 104).

Slot element 74 may be defined by a gap between conductive structures in display module 104 and portions of sidewall 12W (e.g., ledge 170) that is not necessarily in the same X-Y plane as display module 104. As such, regardless of the vertical placement of antenna resonating element arm 142, antenna resonating element arm 142 and support structure 160 may still be disposed within slot element 74. In other words, in both the original vertical placement configuration of antenna resonating element 142 shown in FIG. 8 and the raised vertical placement of antenna resonating element 142, antenna resonating element 142 may be disposed in slot element 74.

To operate antenna 40-2, device 10 may include printed circuit 164 that may be coupled to antenna resonating element arm 142 and to other antenna resonating elements such as an antenna ground for antenna 40-2 using printed circuit 162. As an example, printed circuit 164 may be the same as main logic board 90 in FIG. 6, on which transceiver circuitry 48 (FIG. 6) may be mounted. In this example, transceiver circuitry 48 may provide antenna signals to antenna resonating element arm 142 and the other antenna elements for antenna 40-2 and may receive antenna signals from antenna resonating element arm 142 and the other antenna elements for antenna 40-2. If desired, printed circuit 164 may be implemented separately from main logic board 90 (e.g., implemented as part of a separate flexible and/or rigid printed circuit board separate from main logic board 90). If desired, transceiver circuitry for antenna 40-2 may be mounted in any other suitable manner. If desired, printed circuit 164 may be used to implement one or more portions of printed circuit 140 (FIG. 7), transmission line structures (e.g., on printed circuit 162), and/or antenna elements (e.g., a portion of an antenna ground for antenna 40-2), may be implemented separately from printed circuit 140 and printed circuit 162, and/or may be coupled to and through portions of printed circuit 140 and printed circuit 162 when forming connections to antenna elements for antenna 40-2.

Printed circuit 162 may be implemented as a flexible printed circuit that is coupled to printed circuit 164 via a connector or other conductive interconnect structures. Conductive traces in printed circuit 162 may form transmission line structures for feeding antenna signals to antenna 40-2. The conductive traces in printed circuit 162 may form an antenna signal path coupled to feed path 147 for antenna resonating element arm 142 and may form a ground antenna signal path coupled to an antenna ground for antenna 40-2. This is merely illustrative. If desired, other conductive interconnect structures such as conductive contact pads, conductive pins, conductive springs, conductive adhesive, conductive clips, solder, welds, conductive wires, or any other suitable conductive interconnect structures may be used instead of or in addition to the conductive traces in printed circuit 162 to connect transceiver circuitry to antenna elements (e.g., antenna resonating element arm 142 and the antenna ground) for antenna 40-2.

Figure 9:
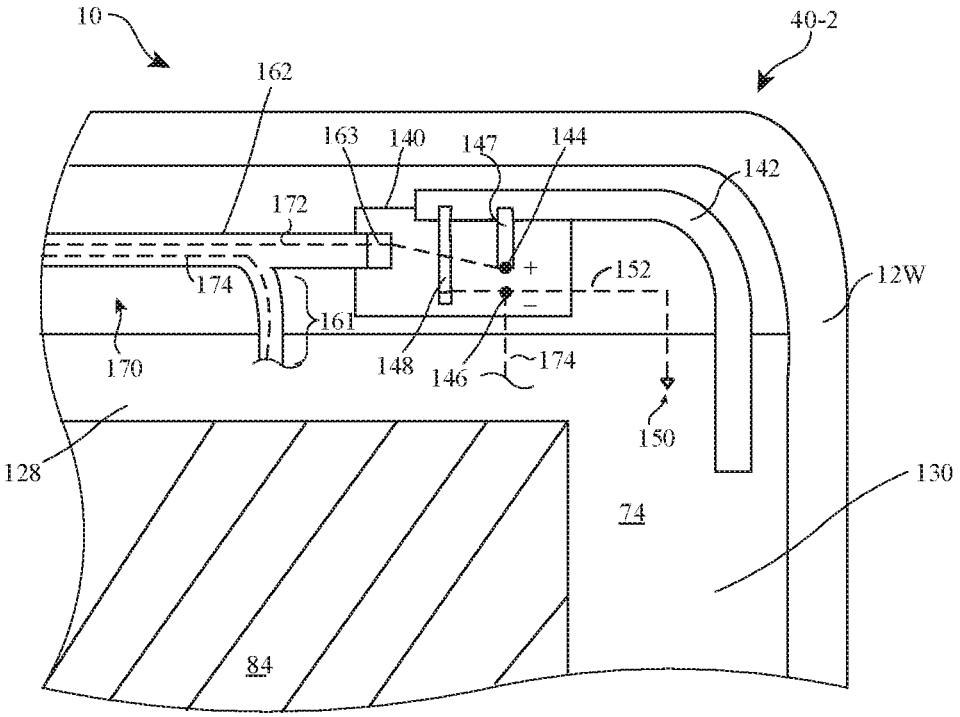
FIG. 9 is a top-down view of a portion of a slot element of the type shown in FIG. 7 in which antenna structures are formed in accordance with some embodiments.

FIG. 9 shows a detailed top-down view of antenna elements for antenna 40-2 disposed within slot element 74. As shown in FIG. 9, printed circuit 140 may be provided on ledge 170 of sidewall 12W and may include conductive traces that form an antenna ground for antenna 40-2. The antenna ground on printed circuit 140 may be coupled to other conductive elements that form the antenna ground for antenna 40-2 such as conductive sidewalls 12W and/or conductive traces on a main logic board (e.g., printed circuit 164 in FIG. 8, printed circuit 90 in FIG. 6).

As an example, at least a portion of the antenna ground for antenna 40-2 may be formed from conductive ground traces at a bottom surface of printed circuit 140. These conductive ground traces on printed circuit 140 may be connected to conductive sidewalls 12W through screws, other conductive retaining members securing components within device 10, or other conductive members. These conductive ground traces on printed circuit 140 may be connected to conductive ground traces on a main logic board through conductive traces in a connecting printed circuit or other conductive members. These examples are merely illustrative. If desired, antenna ground for antenna 40-2 may be formed any suitable one or combination of conductive structures (e.g., housing structures, conductive traces, device components, etc.) connected using any suitable means such as conductive wires, conductive adhesive, conductive fasteners such as screws, conductive pins, conductive clips, conductive brackets, solder, welds, and/or any other desired conductive interconnect structures.

Antenna resonating element arm 142 may be formed on a support structure such as support structure 160 (FIG. 8). Return path 148 may couple antenna resonating element arm 142 to the antenna ground for antenna 40-2 (e.g., grounding structure 150 such as sidewall 12W) via path 152, which may include conductive traces in printed circuit 140, a conductive fastener for retaining components such as a vibrator, and/or other connective structures.

Printed circuit 162 may be disposed on ledge 170 of sidewall 12W and may be coupled to printed circuit 140 using connector 163. Printed circuit 162 may provide transmission line structures for feeding antenna 40-2 such as antenna signal line (path) 172 and antenna ground signal line (path) 174. Antenna signal path 172 may include conductive traces in printed circuit 162 and conductive traces in printed circuit 140, and may be coupled to positive antenna feed terminal 144. Antenna ground path 174 may include conductive traces in printed circuit 162 and conductive traces in printed circuit 140, and may be coupled to ground antenna feed terminal 146. In the example of FIG. 9, printed circuit 162 may include a branched-off portion 161 that includes the conductive traces in ground path 174. Portion 161 may route antenna ground path 174 to other components in device 10 such as a logic board, a grounding structure, etc. Antenna ground path 174 may ultimately connect to a ground antenna feed terminal for antenna 40-2 (e.g., terminal 146). If desired, ground path 174 may be coupled to ground antenna feed terminal 146 directly through connector 163 and conductive traces in printed circuit 140 (similar to antenna signal path 172).

These examples for implementing antenna signal path 172 and antenna ground path 174 are merely illustrative. If desired, antenna signal path 172 and/or antenna ground path 174 may include any suitable conductive interconnect structures such as conductive traces, conductive wires, conductive adhesive, conductive fasteners such as screws, conductive pins, conductive clips, conductive brackets, solder, welds, electrical components, conductive structural housing members, and/or any other desired conductive interconnect structures. If desired, transmission line structure may be implemented in manners other than using printed circuit 162 (e.g., a coaxial cable, a waveguide transmission line, etc.).

Figure 10:
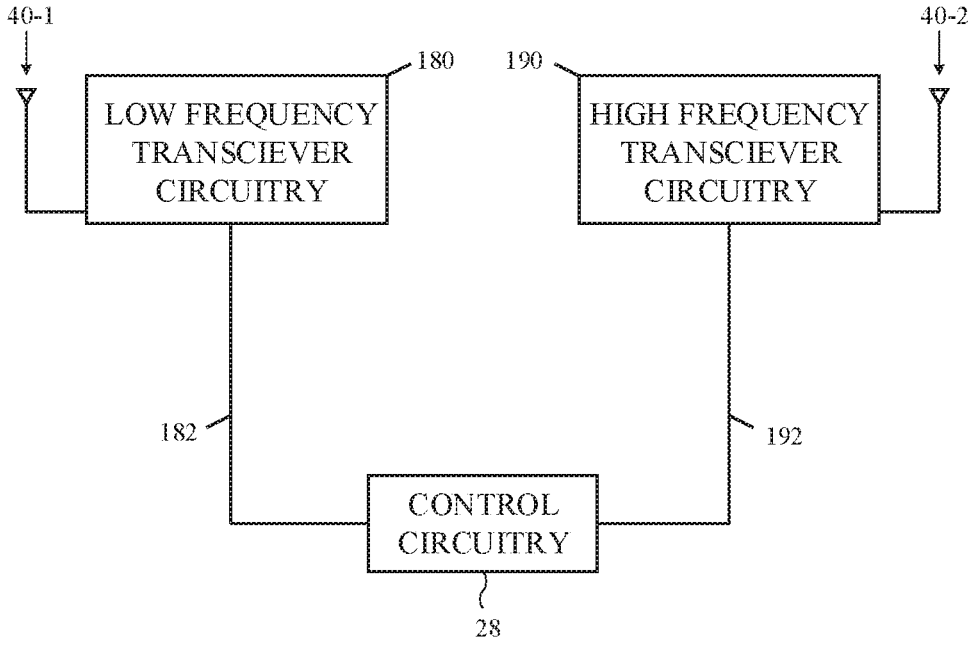
FIG. 10 is a schematic diagram of illustrative transceiver circuitry for operating an antenna of the type shown in FIG. 7 in accordance with some embodiments.

FIG. 10 shows illustrative circuitry for operating antennas 40-1 and 40-2 as described in connection with FIGS. 4-9. In the example of FIG. 10, control circuitry 28 (i.e., control circuitry 28 in FIG. 2) may be coupled to low frequency transceiver circuitry 180 via path 182 and may be coupled to high frequency transceiver circuitry 190 via path 192. Low frequency transceiver circuitry 180 may be configured to provide antenna signals to and receive antenna signals from antenna 40-1 for frequencies in a first range of frequencies. High frequency transceiver circuitry 190 may be configured to provide antenna signals to and receive antenna signals from antenna 40-2 for frequencies in a second range of frequencies. The first range of frequencies may be lower than the second range of frequencies. If desired, the first range of frequencies may partially overlap the second range of frequencies.

As examples, low frequency transceiver circuitry 180 may include transceiver circuitry for supporting frequencies in a first frequency band from 1.5 GHz to 2.2 GHz that covers WLAN, WPAN, satellite navigation, cellular mid-band, and/or some cellular high band frequencies and a second frequency band from 2.2 GHz to 3.0 GHz that covers WLAN/WPAN frequencies. This is merely illustrative. If desired, low frequency transceiver circuitry 180 may use antenna 40-1 to provide frequency coverage at other suitable frequencies such as frequencies in a third frequency band from 5.0 to 8.0 GHz that covers WLAN frequencies and UWB frequencies.

As examples, high frequency transceiver circuitry 190 may include transceiver circuitry for supporting frequencies in a frequency band from 5.0 to 8.0 GHz that covers WLAN frequencies and UWB frequencies. High frequency transceiver circuitry 190 may provide coverage for the 5.0 to 8.0 GHz band instead of or in addition to low frequency transceiver circuitry 180 providing coverage in the same band. This is merely illustrative. If desired, high frequency transceiver circuitry 190 may use antenna 40-2 to provide frequency coverage at other suitable frequencies.

Control circuitry 28 may separately control transceiver circuitries 180 and 190 to operate antennas 40-1 and 40-2 across low and high frequency bands, respectively, thereby increasing frequency coverage for the overall antenna system in device 10 (FIG. 2). Additionally, by implementing antenna 40-2 using an antenna resonating element arm within a slot element that forms antenna 40-1, device 10 may be provided with compact and well-integrated antennas that behave symbiotically (e.g., slot element 74 forming a window for antenna resonating element arm 142 in FIG. 8, antenna resonating element arm 142 formed within existing slot structures as to not take up additional space). Moreover, antennas 40-1 and 40-2 may exhibit relatively high electromagnetic antenna isolation between each other (e.g., because the respective high electric field locations 154 and 156 in FIG. 7 are spaced relatively far apart). Consequently, device 10 may implement compact antennas 40 (e.g., antennas 40-1 and 40-2) having increase bandwidth with still maintaining satisfactory isolation between the antennas.

Figure 11:
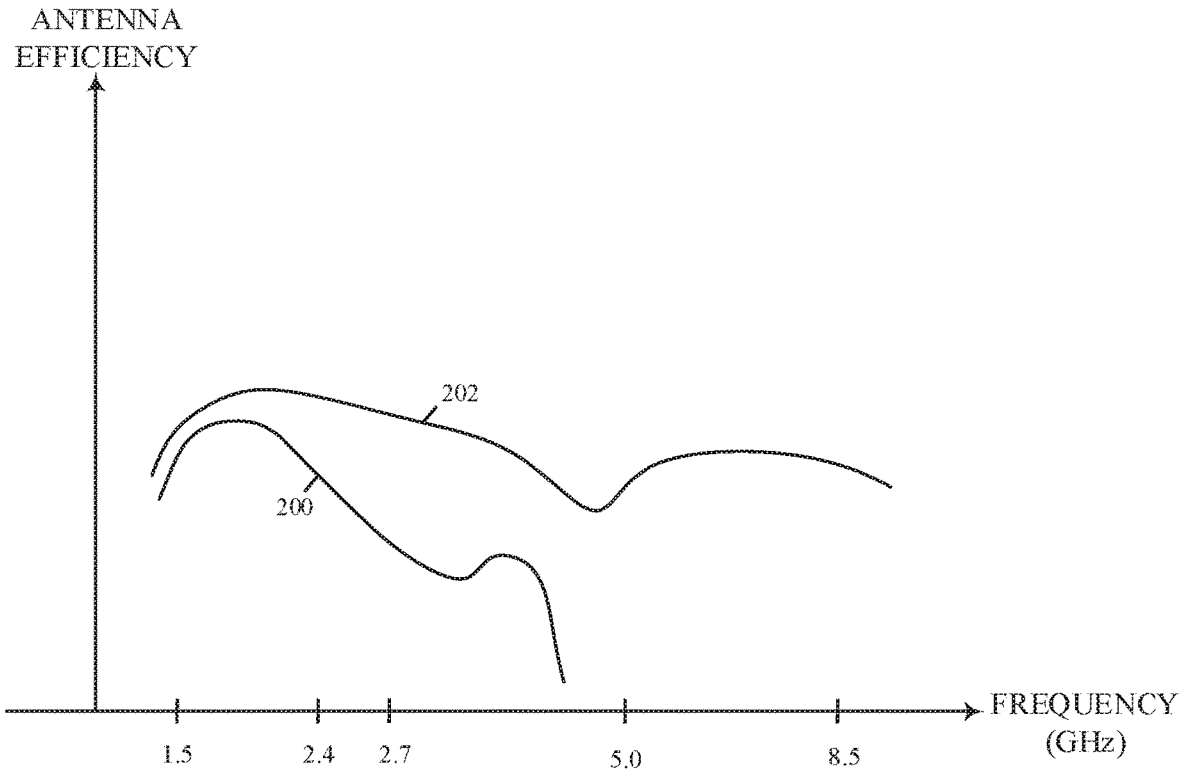
FIG. 11 is a graph of antenna performance (antenna efficiency) for illustrative antenna structures of the types shown in FIGS. 4-10 in accordance with some embodiments.

FIG. 11 is a graph in which antenna performance (antenna efficiency) has been plotted as a function of operating frequency for antennas 40 in device 10 (FIG. 2). As shown in FIG. 11, curve 200 plots the antenna efficiency of antennas 40 in device 10 in the absence of antenna 40-2 as shown and described in connection with FIGS. 7-10. As shown by curve 200, other antenna structures for antennas 40 (e.g., antenna structures formed from display circuitry, formed on rear housing antenna structures, formed from peripheral conductive structures, etc.) may support reasonable antenna efficiencies at relatively low frequencies such as frequencies in the GPS band at 1.5 GHz, the cellular midband from 1.4 GHz to 2.2 GHz, the cellular high band at 2.2 GHz, the 2.4 GHz WLAN/WPAN band, and any other relatively low frequency bands. However, these antenna structures may be unable to provide increased bandwidth to cover relatively high frequencies such as the frequencies in the UWB communications band from about 5.0 GHz to about 8.5 GHz.

Curve 202 plots the antenna efficiency of antennas 40 in device 10 in scenarios where antenna 40-2 as shown and described in connection with FIGS. 7-10 are present. As shown by curve 202, the other antenna structures for antennas 40 may still support reasonable antenna efficiencies at relatively low frequencies such as frequencies in the GPS band at 1.5 GHz, the cellular midband from 1.4 GHz to 2.2 GHz, the cellular high band at 2.2 GHz, the 2.4 GHz WLAN/WPAN band, and any other relatively low frequency bands. At the same time, antenna 40-2 as shown and described in connection with FIGS. 7-10 may support efficiency peaks at higher frequencies such as frequencies in the UWB communications band from about 5.0 GHz to about 8.5 GHz. In this way, antennas 40 for device 10 may exhibit satisfactory antenna efficiency across each of these bands despite the constrained form factor of device 10. The example of FIG. 11 is merely illustrative. In general, efficiency curve 202 may have other shapes. Curve 202 (i.e., antennas 40 including antenna 40-2) may exhibit efficiency peaks in any desired number of frequency bands and across any desired frequencies.

The foregoing is merely illustrative and various modifications can be made to the described embodiments. The foregoing embodiments may be implemented individually or in any combination.

What is claimed is:

1. An electronic device comprising:

a housing having a conductive housing wall;

a display cover layer mounted to the housing;

conductive display structures that overlap the display cover layer;

a slot antenna radiating element for a first antenna, the slot antenna radiating element being formed from a slot defined by the conductive housing wall and the conductive display structures; and an antenna radiating element arm for a second antenna, wherein the antenna radiating element arm is disposed entirely within the slot and is interposed between the conductive housing wall and the conductive display structures.

2. The electronic device defined in claim 1, wherein the antenna radiating element arm for the second antenna comprises a conductive trace formed on a dielectric support structure within the slot.

3. The electronic device defined in claim 2, wherein the conductive housing wall includes a ledge on which the dielectric support structure is mounted.

4. The electronic device defined in claim 3, wherein the conductive housing wall includes an additional ledge to which the display cover layer is coupled using an attachment structure.

5. The electronic device defined in claim 1, wherein a width of the slot is defined by a distance from the conductive housing wall to the conductive display structures, a length of the slot is defined by conductive interconnect structures that couple the conductive housing wall to the conductive display structures, and the antenna radiating element arm lies within the width of the slot and extends along the length of the slot.

6. The electronic device defined in claim 5, wherein the slot has a bend along the length of the slot and the antenna radiating element arm has a bend that follows the bend of the slot.

7. The electronic device defined in claim 1, further comprising:

a printed circuit aligned with the slot and coupled to the antenna radiating element arm, the printed circuit including conductive traces that form an antenna ground for the second antenna.

8. The electronic device defined in claim 7, wherein the conductive housing wall forms part of the antenna ground for the second antenna and the second antenna includes a return path coupling the antenna radiating element arm to the conductive housing wall using the conductive traces of the printed circuit.

9. The electronic device defined in claim 8, wherein the second antenna includes a feed leg coupled to the antenna radiating element arm and includes an antenna feed coupled between the feed leg and the antenna ground for the second antenna.

10. The electronic device defined in claim 9, further comprising:

an additional printed circuit aligned with the slot and coupled to the printed circuit, the additional printed circuit including a transmission line structure for providing antenna signals to the antenna feed of the second antenna.

11. An electronic device comprising:

a conductive housing member;

conductive display structures in a display module;

a display cover layer mounted to the conductive housing member and overlapping the display module;

a slot antenna formed from a dielectric opening, the dielectric opening having opposing edges defined by the conductive housing member and the conductive display structures, wherein the slot antenna extends around two sides of the conductive display structures; and an additional antenna that includes a conductive trace disposed on a dielectric support structure, wherein the dielectric opening of the slot antenna overlaps the conductive trace and the dielectric support structure is mounted to the conductive housing member.

12. The electronic device defined in claim 11, wherein the dielectric support structure is mounted to a step portion of the conductive housing member.

13. The electronic device defined in claim 12, wherein the slot antenna has a first segment running along a first side of the two sides of the conductive display structures and a second segment running along a second side of the two sides of the conductive display structures, the additional antenna having a first portion that extends along the first segment within the dielectric opening and has a second portion that extends along the second segment within the dielectric opening.

14. The electronic device defined in claim 11, wherein the slot antenna is configured to radiate in a first frequency band, and the additional antenna is configured to radiate in a second frequency band that is greater than the first frequency band and to convey radio-frequency signals through the dielectric opening and the display cover layer.

15. The electronic device defined in claim 14, wherein the second frequency comprises an ultra-wide band (UWB) frequency band, the electronic device further comprising:

first radio-frequency transceiver circuitry configured to convey the radio-frequency signals in the UWB frequency band using the additional antenna.

16. The electronic device defined in claim 15, wherein the first frequency band comprises a 2.4 GHz wireless local area network (WLAN) frequency band and a cellular telephone frequency band, the second frequency band comprises a 5 GHz WLAN frequency band, and the UWB frequency band comprises frequencies between 5 GHz and 8.5 GHz, the electronic device further comprising:

second radio-frequency transceiver circuitry configured to convey radio-frequency signals in the 2.4 GHz WLAN frequency band and the cellular telephone frequency band using the slot antenna.

17. A wristwatch comprising:

a housing having conductive sidewalls;

a display cover layer mounted to the conductive sidewalls;

a display module that is overlapped by the display cover layer and that includes conductive display structures;

a slot antenna having a slot element with opposing edges defined by the conductive sidewalls and the conductive display structures, wherein the slot element extends around first and second sides of the conductive display structures; and an additional antenna having an antenna radiating element that is disposed within the slot element and that extends around the first and second sides of the conductive display structures.

18. The wristwatch defined in claim 17, wherein the additional antenna is an antenna selected from the group consisting of an inverted-F antenna, a monopole antenna, and a dipole antenna, and the antenna radiating element of the additional antenna has a resonating element arm that is disposed within the slot element and that extends around the first and second sides of the conductive display structures.

19. The wristwatch defined in claim 17, wherein the slot antenna has an antenna feed coupled across the conductive sidewalls and the conductive display structures, the additional antenna includes additional antenna elements on a printed circuit, and the antenna radiating element has a proximal end that is coupled to the printed circuit and that extends to a distal end away from the antenna feed of the slot antenna.

20. The wristwatch defined in claim 19, wherein the slot element extends around a third side of the conductive display structures parallel to the first side, the antenna feed is coupled to one of the second or third sides of the conductive display structures, and the distal end of the antenna radiating element is disposed within a segment of the slot element adjacent to the first side of the conductive display structures.

* * * * *